US006358393B1

(12) United States Patent
Berclaz et al.

(10) Patent No.: US 6,358,393 B1
(45) Date of Patent: Mar. 19, 2002

(54) ALUMINUM PRODUCTION CELL AND CATHODE

(75) Inventors: Georges Berclaz, Sierre (CH); Vittorio de Nora, Nassau (BS)

(73) Assignee: Moltech Invent S.A., Luxembourg ( * ) Notice: Subject to any disclaimer, the term of this patent is extended or adjusted under 35 U.S.C. 154(b) by 0 days.

(21) Appl. No.: 09/403,537

(22) PCT Filed: May 19, 1998

(86) PCT No.: PCT/IB98/00779

§ 371 Date: Mar. 30, 2000

§ 102(e) Date: Mar. 30, 2000

(87) PCT Pub. No.: WO98/53120

PCT Pub. Date: Nov. 26, 1998

(30) Foreign Application Priority Data

May 23, 1997 (WO) ..... PCT/IB97/00589

(51) Int. Cl.[7] ..... C25C 3/06; C25C 3/08; C25C 3/16

(52) U.S. Cl. ..... 205/374; 205/381; 205/384; 205/386; 205/387; 205/390; 204/244; 204/245; 204/247.3; 204/247.4; 204/247.5; 204/291; 204/292; 204/293; 204/294; 29/592.1

(58) Field of Search ..... 204/243.1, 293, 204/294, 291–292, 247.4, 244, 290.01, 290.12, 290.13, 246; 29/592.1

(56) References Cited

U.S. PATENT DOCUMENTS

| | | | | | |
|---|---|---|---|---|---|
| 2,846,388 | A | * | 8/1958 | Morel | 204/243.1 |
| 2,868,710 | A | * | 1/1959 | Pontremoli | 204/243.1 |
| 3,110,660 | A | * | 11/1963 | Miller | 204/243.1 |
| 3,575,827 | A | * | 4/1971 | Johnson | 204/244 |
| 3,702,815 | A | * | 11/1972 | Nikiforov et al. | 204/243.1 |
| 4,194,959 | A | * | 3/1980 | Hudson et al. | 204/243.1 |
| 4,397,728 | A | * | 8/1983 | Pfister et al. | 204/244 |
| 4,749,463 | A | * | 6/1988 | Holmen | 204/241 |

* cited by examiner

*Primary Examiner*—Donald R. Valentine
(74) *Attorney, Agent, or Firm*—Jayadeep R. Deshmukh

(57) ABSTRACT

A cell for the production of aluminium by the electrolysis of an aluminium compound dissolved in a molten electrolyte, in which an outer mechanical structure forming an outer shell (21) houses therein one or more inner electrically-conductive cathode holder shells or plates (31) which contain a cathode mass (32) and is/are connected electrically to the busbar. The cathode mass (32) has an aluminium-wettable top surface (37), preferably at a slope forming a drained cathode. The inner cathode holder shell or shells (31) is/are separated from the outer shell (21) by an electric and thermic insulation (40), the cathode holder shell(s) (31) also serving to distribute current uniformly to the cathode mass (32). The or each cathode (30) formed by the cathode holder shell (31) and cathode mass (32) is removable from the cell as a unit.

83 Claims, 11 Drawing Sheets

ALUMINUM PRODUCTION CELL AND CATHODE

FIELD OF THE INVENTION

The invention relates to the production of aluminium by the electrolysis of an aluminium compound dissolved in a molten electrolyte, for example alumina dissolved in a molten fluoride-based electrolyte. It concerns in particular, but not exclusively, cells of the type having a drained cathode having sloping drained cathode surfaces. The invention also relates to cathodes of such cells, their manufacture, and methods of operating the cells to produce aluminium.

BACKGROUND OF THE INVENTION

The technology for the production of aluminium by the electrolysis of alumina, dissolved in molten cryolite containing salts, at temperatures around 950° C. is more than one hundred years old.

This process, conceived almost simultaneously by Hall and Héroult, has not evolved as much as other electrochemical processes, despite the tremendous growth in the total production of aluminium that in fifty years has increased almost one hundred fold. The process and the cell design have not undergone any great change or improvement and carbonaceous materials are still used as electrodes and cell linings.

The electrolytic cell trough is typically made of a steel shell provided with an insulating lining of refractory material covered by prebaked anthracite-graphite or all graphite carbon blocks at the cell floor bottom which acts as cathode and to which the negative pole of a direct current source is connected by means of steel conductor bars embedded in the carbon blocks. The side walls are also covered with prebaked anthracite-graphite carbon plates or silicon carbide plates.

The anodes are still made of carbonaceous material and must be replaced every few weeks. The operating temperature is still approximately 950° C. in order to have a sufficiently high rate of dissolution of alumina which decreases at lower temperatures and to have a higher conductivity of the electrolyte.

The carbonaceous materials used in Hall-Héroult cells as cell lining deteriorate under the existing adverse operating conditions and limit the cell life.

The anodes have a very short life because during electrolysis the oxygen which should evolve on the anode surface combines with the carbon to form $CO_2$ and small amounts of CO. The actual consumption of the anode is approximately 450 kg/ton of aluminium produced which is more than ⅓ higher than the theoretical amount.

The carbon lining of the cathode bottom has a useful life of a few years after which the operation of the entire cell must be stopped and the cell relined at great cost. Despite an aluminium pool having a thickness of 10 to 20 cm maintained over the cathode, the deterioration of the cathode carbon blocks cannot be avoided because of penetration of sodium into the carbon which by chemical reaction and intercalation causes swelling, deformation and disintegration of the cathode carbon blocks, and because of penetration of cryolite and liquid aluminium.

The carbonaceous blocks of the cell side wall do not resist oxidation and attack by cryolite and a layer of solidified cryolite has to be maintained on the cell side walls to protect them. In addition, when cells are rebuilt, there are problems of disposal of the carbon cathodes which contain toxic compounds including cyanides.

Another major drawback, however, is due to the fact that irregular electromagnetic forces create waves in the molten aluminium pool and the anode-cathode distance (ACD), also called interelectrode gap (IEG), must be kept at a safe minimum value of approximately 50 mm to avoid short circuiting between the aluminium cathode and the anode or reoxidation of the metal by contact with the $CO_2$ gas formed at the anode surface, leading to a lower current efficiency.

The high electrical resistivity of the electrolyte, which is about 0.4 ohm. cm., causes a voltage drop which alone represents more than 40% of the total voltage drop with a resulting high energy consumption which is close to 13 kWh/kgAl in the most modern cells. The cost of energy consumption has become an even bigger item in the total manufacturing cost of aluminium since the oil crisis, and has decreased the rate of growth of this important metal.

In the second largest electrochemical industry following aluminium, namely the caustic and chlorine industry, the invention of the dimensionally stable anodes (DSA®) based on noble metal activated titanium metal, which were developed around 1970, permitted a revolutionary progress in the chlorine cell technology resulting in a substantial increase in cell energy efficiency, in cell life and in chlorine-caustic purity. The substitution of graphite anodes with DSA® increased drastically the life of the anodes and reduced substantially the cost of operating the cells. Rapid growth of the chlorine caustic industry was retarded only by ecological concerns.

In the case of aluminium production, pollution is not due to the aluminium produced, but to the materials and the manufacturing processes used and to the cell design and operation.

However, progress has been reported in the operation of modern aluminium plants which utilize cells where the gases emanating from the cells are in large part collected and adequately scrubbed and where the emission of highly polluting gases during the manufacture of the carbon anodes and cathodes is carefully controlled.

While progress has been reported in the use of carbon cathodes to which have been applied coatings or layers of new aluminium wettable materials which are also a barrier to sodium penetration during electrolysis, very little progress has been achieved in design of cathodes for aluminium production cells with a view to improving the overall cell efficiency, simplifying assembly of the cathodes in the cell, simplifying the removal and disposal of used cathodes, as well as restraining movement of the molten aluminium in order to reduce the interelectrode gap and the rate of wear of its surface.

U.S. Pat. No. 3,202,600 (Ransley) proposed the use of refractory borides and carbides as cathode materials, including a drained cathode cell design wherein a wedge-shaped consumable carbon anode was suspended facing a cathode made of plates of refractory boride or carbide in V-configuration.

U.S. Pat. No. 3,400,061 (Lewis et al) and U.S. Pat. No. 4,602,990 (Boxall et al) disclose aluminium electrowinning cells with sloped drained cathodes arranged with the cathodes and facing anode surfaces sloping across the cell. In these cells, the molten aluminium flows down the sloping cathodes into a median longitudinal groove along the center of the cell, or into lateral longitudinal grooves along the cell sides, for collecting the molten aluminium and delivering it to a sump.

U.S. Pat. No. 4,544,457 (Sane et al) proposed a drained cathode arrangement in which the surface of a carbon cathode block was covered with a sheath that maintained stagnant aluminium on its surface in order to reduce wear. In this design, the cathode block stands on the cell bottom.

U.S. Pat. No. 5,203,971 (de Nora et al) discloses an aluminium electrowinning cell having a partly refractory and partly carbon based cell lining. The carbon-based part of the cell bottom may be recessed in respect to the refractory part, which assists in reducing movement of the aluminium pool.

U.S. Pat. No. 3,856,650 (Kugler) proposed lining a carbon cell bottom with a ceramic coating upon which parallel rows of tiles are placed, in the molten aluminium, in a grating-like arrangement in an attempt to reduce wear due to movements of the aluminium pool.

To restrict movement in a "deep" cathodic pool of molten aluminium, U.S. Pat. No. 4,824,531 (Duruz et al) proposed filling the cell bottom with a packed bed of loose pieces of refractory material. Such a design has many potential advantages but, because of the risk of forming a sludge by detachment of particles from the packed bed, the design has not found acceptance. U.S. Pat. No. 4,443,313 (Dewing et al) sought to avoid this disadvantage of the previously mentioned loose packed bed by providing a monolayer of closely packed small ceramic shapes such as balls, tubes or honeycomb tiles.

An improvement described in U.S. Pat. No. 5,472,578 (de Nora) consisted in using grid-like bodies which could form a drained cathode surface and simultaneously restrain movement in the aluminium pool.

U.S. Pat. No. 5,316,718 and WO 93/25731 (both in the name of Sekhar et al) proposed coating components with a slurry-applied coating of refractory boride, which proved excellent for cathode applications. These publications included a number of novel drained cathode configurations, for example including designs where a cathode body with an inclined upper drained cathode surface is placed on or secured to the cell bottom.

In U.S. Pat. No. 5,362,366 (de Nora et al), a double-polar anode-cathode arrangement was disclosed wherein cathode bodies were suspended from the anodes permitting removal and reimmersion of the assembly during operation, such assembly also operating with a drained cathode.

U.S. Pat. No. 5,368,702 (de Nora) proposed a novel multimonopolar cell having upwardly extending cathodes facing and surrounded by or in-between anodes having a relatively large inwardly-facing active anode surface area. In some embodiments, electrolyte circulation was achieved using a tubular anode with suitable openings.

WO 96/07773 (de Nora) proposed a new cathode design for a drained cathode, where grooves or recesses were incorporated in the surface of blocks forming the cathode surface in order to channel the drained product aluminium.

As regards the supply of current to the cathodes, the most usual arrangement is to have horizontal cathode current supply bars which extend across the cell bottom and protrude from its sides (see for example U.S. Pat. No. 4,834,531 referred to above). These horizontal current supply bars conveniently are located in grooves in the bottom surfaces of the cathode blocks, as illustrated in WO 96/07773 (de Nora), and extend all the way across the cell bottom.

By these means, current is supplied to the cathodes from external buswork extending along the sides of the cells. After passing through the electrolysis cell by ionic conduction, the current is taken up by the anodes suspended by an anode suspension and current-supply superstructure. Conventionally, this superstructure supplies current to a line of cells whose cathodes and anodes are all connected together to cathode and anode buswork.

Proposals have also been made to supply current to the cathodes via generally vertical current collector bars. These proposals—see for example U.S. Pat. No. 5,071,533 (de Nora et al) and U.S. Pat. No. 4,613,418 (Dewing et al)—have concerned non-carbon cell bottoms, where it was intended to replace the conventional carbon cathode with a non-conductive refractory material such as various grades of compacted particulate fused alumina. In this case, the current collector bar serves to deliver current to a pool or layer of aluminium. Such proposals however encountered various difficulties, so that carbon cathodes remain as industry standard and are particularly advantageous when coated with a slurry-applied layer of an aluminium-wettable boride.

EP-A-0 345 959 (Nebell et al) discloses a potline for the electrolytic production of aluminium which comprises rows of reduction cells with cells arranged transversely in each row, each cell having at least one conductor projecting through the bottom of the cell for each carbon cathode block. About half of the electric current is conducted to a cathode collector busbar and the other half to another collector busbar from where the current is carried to the next cell via two busbars.

U.S. Pat. No. 3,110,660 (Miller) discloses an electrolytic cell for the production of aluminium wherein the cathode comprises a plurality of carbon slabs which are located along the bottom of the cell on a metallic support pan for conducting away the current. The current collecting pan has lateral extensions extending through the sidewalls of the cell and welded to external steel conductor bars.

WO 97/48838 (Juric et al) whose priority date is Jun. 18, 1996 and which was published on Dec. 24, 1997, discloses an electrolytic reduction cell whose cathode comprises a carbonaceous cathode block having a plurality of electrical contact plugs mounted in electrical contact to and above a collector plate for collecting current from the cathode blocks. The collector plate is joined to or integrally formed with collector bars extending through the sidewalls.

While the foregoing references indicate continued efforts to improve the operation of molten cell electrolysis operations, none suggest the invention and there have been no acceptable proposals for improving the efficiency of the supply of electric current to a cathode body, while simplifying assembly and replacement of the cathodes, and at the same time facilitating the implementation of a drained cathode configuration.

OBJECTS OF THE INVENTION

One object of the invention is to overcome problems inherent in the conventional design of cells used in the electrowinning of aluminium by the electrolysis of an aluminium compound such as alumina dissolved in molten electrolyte for example fluoride-based melts in particular cryolite, notably by improving the efficiency of the supply of electric current to a cathode body.

Another object of the invention is to permit more efficient cell operation by modifying the design of the cathode to improve the distribution of electric current to the cathode.

A further object of the invention is to provide a novel cathode permitting improved distribution of electric current, which can be easily produced and fitted in the cell, and which simplifies dismantling of the cell to replace or refurbish the cathodes.

A yet further object of the invention is to provide an improved cathode which facilitates the implementation of a drained cell configuration.

Yet another object of the invention is to provide a system for interconnecting aluminium production cells enabling reduction of the total floorspace needed for a given production, by providing a simplified buswork arrangement while maintaining ease of access to the cells for maintenance.

A yet further object of the invention is to provide a cathode of novel design enabling drained cathode operation where ease of removal of the anodically produced gases is combined with ease of collection of the product aluminium.

An even further object of the invention is to provide an aluminium production cell in which fluctuating electric currents that produce a variable electromagnetic field are reduced or eliminated thereby reducing or eliminating the adverse effects that lead to a reduction of the cell efficiency.

SUMMARY OF THE INVENTION

One main aspect of the invention concerns a cell for the production of aluminium by the electrolysis of an aluminium compound dissolved in a molten electrolyte, in which the electric current to the cathode arrives through an inner cathode holder shell or plate (hereinafter sometimes referred to simply as "inner shell") placed between the cathode and the outer shell, usually made of steel.

In this cell, an inner cathode holder shell (or plate) of metal or suitable electrically conductive material is placed between the cathode surface and the outer shell, the inner shell serving to distribute current uniformly to the cathode and being connected directly to the negative busbar.

More precisely, the invention concerns a cell for the production of aluminium by the electrolysis of an aluminium compound dissolved in a molten electrolyte, in which an electrically-conductive inner cathode holder shell or plate, electrically connected to the negative busbar, is located inside the outer shell of the cell, the inner shell containing and/or supporting a cathode mass and being separated from the outer shell by an electric and thermic insulating mass, the inner shell also serving to distribute current to the cathode mass.

In other terms, in the aluminium production cell according to the invention, an outer mechanical structure forming an outer shell houses therein an inner electrically-conductive shell (or plate) which contains and/or supports a cathode mass. This plate or shell is connected electrically to the busbar and the inner cathode holder plate or shell is separated from the outer shell by an electric and thermic insulation. This inner plate or shell thus serves to support the cathode mass and to distribute current to it.

Another aspect of the invention is an aluminium production cell of the type with a drained cathode, wherein a cathode holder of electrically conductive material is placed between an outer shell of the cell and the drained cathode. This cathode holder is connected by collector bars to the outside of the outer shell, whereby the cathode holder maintains the collector bars at practically constant electrical potential leading to a constant current distribution in the collector bars and a uniform distribution of electric current in the cathode. This furthermore eliminates current fluctuations due to poor distribution and flow of current typical in conventional cells, thereby reducing or eliminating the resulting non-uniform electro-magnetic field that can create movement in the molten aluminium.

The cathode and its holder shell (or plate) are separated from the outer shell of the cell by insulating and refractory materials such as the usual types of insulating bricks used for cell linings. It is also possible to provide an air or gas space between the inner shell and the insulating and refractory materials. This space can be used to control the temperature of the inner shell by supplying heating or cooling gas, notably hot gas to heat the inner shell and cathode mass during cell start up.

The cathode mass can be made mainly of carbonaceous material, such as compacted powdered carbon, a carbon-based paste for example as described in U.S. Pat. No. 5,362,366 (Sekhar et al), prebaked carbon blocks assembled together on the shell, or graphite blocks, plates or tiles.

It is also possible for the cathode to be made mainly of an electrically-conductive non-carbon material, or of a composite material made of an electrically-conductive material and an electrically non-conductive material.

In such a composite material, the non-conductive material can be alumina, cryolite, or other refractory oxides, nitrides, carbides or combinations thereof and the conductive material can be at least one metal from Groups IIA, IIB, IIIA, IIIB, IVB, VB and the Lanthanide series of the Periodic Table, in particular aluminium, titanium, zinc, magnesium, niobium, yttrium or cerium, and alloys and intermetallic compounds thereof.

The composite material's metal preferably has a melting point from 650° C. to 970° C., or above.

The composite material is advantageously a mass made of alumina and aluminium or an aluminium alloy, see U.S. Pat. No. 4,650,552 (de Nora et al), or a mass made of alumina, titanium diboride and aluminium or an aluminium alloy.

The composite material can also be obtained by micropyretic reaction such as that utilizing, as reactants, $TiO_2$, $B_2O_3$ and Al.

The cathode can also be made of a combination of at least two materials from : at least one carbonaceous material as mentioned above; at least one electrically conductive non-carbon material; and at least one composite material of an electrically conductive material and an electrically non-conductive material, as mentioned above.

The cathode should be impervious and resistant or substantially impervious and resistant to molten aluminium and to the molten electrolyte, and can be rendered aluminium-impervious by one or more layers of fibers and/or by layers of a composite material as discussed above.

The cathode can comprise active cathode material and reinforcing material, one example being carbon fibers impregnated with a slurry of titanium diboride, possibly further impregnated with aluminium. It can also comprise layers of imbricated tiles or slabs of carbon, an electrically conductive material, or a composite material made of electrically conducting material and electrically non-conducting material. Advantageously a cloth of aluminium impervious material is placed between some or all of the layers of tiles or slabs.

The cathode most preferably has an upper active surface which is aluminium-wettable, for example the upper surface of the cathode is coated with a coating of refractory aluminium wettable material as described in U.S. Pat. No. 5,364,513 (Sekhar et al) and U.S. Pat. No. 5,651,874 (Sekhar et al). Also, the upper surface of the inner shell in contact with the cathode can be coated with a coating of refractory aluminium-wettable material or other protective materials.

The aluminium-wettable surface usually comprises a refractory boride, advantageously applied as a coating from a slurry of particles of the refractory boride or other aluminium-wettable material.

The aluminium-wettable surface can be obtained by applying a top layer of refractory aluminium-wettable material over the upper active surface of the cathode (which can already have a precoating of the refractory aluminium wettable material) and over parts of the cell surrounding the cathode.

In most preferred embodiments, the cathode is a drained cathode. Preferably, the upper surface of the cathode is at a slope so as to operate as a drained cathode, the upper surface of the cathode for example comprising opposed sloping surfaces leading down into a central channel for the continuous removal of product aluminium. This central draining channel (or a side channel or several channels in other embodiments) leads into an aluminium storage sump or space which is internal or external to the cell and from which the aluminium can be tapped from time to time, as described for instance in U.S. Pat. No. 5,683,559 (de Nora).

Alternatively, the upper surface of the cathode comprises a series of oppositely sloping surfaces forming therebetween recesses or channels of various shapes, for example generally V-shaped.

The cathode current collector bars can either extend down through the bottom of the cell or extend out through the sides of the cell. In the former case, each cathode comprises a plurality of cathode current connector bars extending down through the bottom of the cell, the current connector bars being spaced apart along the center line of the cathode or being symmetrically distributed.

The cathode holder shell (or plate) is preferably made of metal or other suitable highly electrically conductive material. Conveniently, the cathode holder shell is made of metal and comprises a substantially flat bottom with upwardly-protruding side edges approximately at right angles to the substantially flat bottom or angled out relative to the substantially flat bottom. These upwardly-protruding edges can have outwardly projecting flanges that rest on shoulders of the cell side wall. Such flanges can also be arranged to assist lifting of the entire cathode by a crane if desired for refurbishing.

The cathode holder shell's upwardly-protruding edges can extend all around the periphery of the shell, but in some embodiments can extend only partly around the periphery, for example along two opposite sides. In the case where a supporting plate is used, there are no upwardly protruding edges.

The cathode holder shell (or plate) is usually made of a sheet of imperforate metal but can also be made of a sheet of perforated metal or of a series of metal members assembled together with or without spacings between them, the arrangement being such that this shell fulfills its function of supporting the cathode mass and uniformly distributing current to the cathode mass.

It can also be made of a series of containers each having one or more electrical feeders.

Each cell can comprise a single cathode made up of a cathode supported on its holder shell provided with current collector bars. In this case, the single cathode fits as a unit in a corresponding central recess in the cell, and the cathode surface (usually drained) cooperates with a series of anodes. For example, the cathode has a series of sloping drained cathode surfaces facing corresponding sloping anode surfaces.

Alternatively, a cell design is contemplated where the cell bottom has several recesses receiving a corresponding number of individual cathodes, each cathode cooperating with one anode or a series of anodes. In this case, the individual cathodes (inner cathode holder shell, cathode mass and current collector bar(s)) can each be installed and removed as a unit.

The cells according to the invention can make use of traditional consumable prebaked carbon anodes, continuously-fed Söderberg-type anodes, as well as non-consumable or substantially non-consumable anodes, such as metal anodes based on nickel-iron-aluminium or nickel-iron-aluminium-copper with an oxide surface, for example as described in U.S. Pat. No. 5,510,008 (de Nora et al).

Whether consumable prebaked anodes or non-consumable anodes are used, it is advantageous to preheat each anode before it is installed in the cell during operation, in replacement of a carbon anode which has been substantially consumed, or a non-consumable anode that has become disactivated or requires servicing. By preheating the anodes, disturbances in cell operation due to local cooling are avoided as when an electrolyte crust is formed whereby part of the anode is not active until the electrolyte crust has melted.

Another aspect of the invention is a cathode for a cell for the production of aluminium by the electrolysis of an aluminium compound dissolved in a molten electrolyte. This cathode comprises a cathode mass formed mainly of electrically conductive material and a cathode holder shell (or plate) of good electrically conductive material such as metal. The cathode mass is supported on and substantially coextensive with the holder shell. An active cathode surface, such as a slurry-applied coating of an aluminium-wettable boride, is arranged on the upper surface of the cathode mass which can itself be aluminium wettable, and a current collector bar is connected to the underside or sides of the holder shell for the supply of current to the cathode. This cathode holder shell thus serves to feed current and uniformize distribution of the current supplied via the collector bar to the cathode mass.

This cathode can incorporate all of the features described above in relation to the cell.

The invention also concerns a method of manufacturing this cathode, comprising providing a holder shell (or plate) made of one or more sheets or members of highly electrically-conductive material such as metal, supporting on the cathode holder shell a cathode mass which is substantially coextensive therewith to form a cathode mechanically supported by and electrically connected to the holder shell, and connecting at least one current collector bar to the underside of the holder shell, or to its side(s).

Another inventive aspect is a method of producing a cathode and installing it as a unit in an aluminium production cell, the same method applying equally to producing and installing a series of cathodes. This method comprises placing an electrically-conductive cathode mass (for example mainly of carbonaceous material) on a cathode holder shell (or plate) to form a cathode wherein current can be supplied to the cathode mass by a current collector bar and distributed uniformly over the cathode mass by the holder shell. This cathode, comprising the cathode mass placed on its holder shell, is then installed in an outer shell forming the bottom and sides of the cell, and the inner cathode holder shell is connected to the outside of the outer shell by a current collector bar.

The invention also provides an improved cathode pot of a cell for the production of aluminium by the electrolysis of an aluminium compound dissolved in a molten electrolyte, of the type comprising an outer mechanical structure which forms an outer shell of the cathode pot, and an electric and thermic insulator forming a potlining. In known cells, a cathode is supported on the electric and thermic insulator which separates the cathode from the outer shell, and at least one conductor bar connects the cathode to outside the outer shell for connection to an external negative busbar, the or each conductor bar extending through the electric and thermic insulator.

The improved cathode pot according to the invention includes at least one cathode which advantageously can be installed in and removed from the cathode pot as a unit. The or each cathode comprises a cathode holder formed by a metallic shell or plate of an electrically conducting material and a cathode mass constituted mainly of electrically-conductive material supported by the cathode holder, the cathode mass preferably having an aluminium-wettable active surface. The or each cathode holder is connected to outside the outer shell by at least one said conductor bar, the cathode holder serving to uniformize distribution of electric current from the conductor bars(s) to the cathode mass.

The invention also pertains to a method of supplying electric current to a cathode mass of an aluminium production cell, the method comprising supplying current via one or more cathode current collector bars to the bottom of the cathode mass, the current collector bar(s) being of small cross-section compared to the size of the cathode bottom. The current supplied via the current collector bar is distributed uniformly over the entire bottom of the cathode mass by means of a current distributor shell (or plate) substantially coextensive with the entire bottom of the cathode mass, thus serving to keep the entire bottom of the cathode at practically the same potential. The current passing from the current distributor shell into the cathode mass is hence evenly distributed over the cathode mass. Moreover, when several current collector bars are connected to the current distributor shell, the current collector bars are held at the same potential which equalizes current supply via the collector bars.

The invention also provides for renovating an aluminium production cell according to the invention after the cell has been taken out of service. This method comprises also the possibility of removing, as a unit, the or each used cathode and its support shell and replacing each entire used cathode by one or more new or renovated cathode units. By this means, renovation of the cell is greatly simplified because removal of the cathode as one or more units avoids the need to mechanically break up the used cathode mass using jackhammers or like tools, which has heretofore been the usual practice. Furthermore, installing the new or renovated cathode is much simpler than rebuilding a new cathode lining in situ.

The invention also contemplates transforming an existing Hall-Héroult cell into a cell according to the invention by shutting down the cell and removing the used cathode for example in the normal way using jackhammers, refurbishing and/or rebuilding the insulating lining formed by the electric and thermic insulating mass as necessary, and fitting one or more cathode units as discussed above.

A method of producing aluminium according to the invention using the cell as outlined above, involves supplying current to the cathode via the current collector bar and the or each cathode holder shell (or plate) which distributes the current to the cathode mass evenly and maintains the cathode current collectors at the same potential. As a result, in cell operation, there are less disturbances by electromagnetic fields due to horizontal electric currents in the metal, and the overall cell efficiency is improved.

Advantageously, the surface of the cathode mass is maintained at a temperature corresponding to a paste state of the electrolyte whereby the cathode mass is protected from chemical attack. For example, when the cryolite-based electrolyte is at about 950° C., the surface of the cathode mass can be cooled by about 30° C., whereby the electrolyte contacting the cathode surface forms a viscous paste which protects the cathode surface. The surface of the cathode mass can be maintained at the selected temperature by supplying gas via an air or gas space between the cathode holder and the electric and thermic insulating mass.

The cathodes of the invention can also be used in a novel arrangement for conducting electric current between aluminium electrowinning cells disposed in side by side relationship wherein the busbar connected to the inner cathode holder shell of the cathode of one cell is connected directly to the anode current supply of an adjacent cell.

In such an arrangement, each cell comprises a cell base having a cathodic cell bottom fitted with current collector bars at or adjacent to the bottom of the cell for feeding current to the cathodic cell bottom, and a cell superstructure comprising anodes and means for supplying current to the anodes. The cells can be connected so that current is conducted between the adjacent cells by conductor bars crossing-over from one cell to an adjacent cell, each crossing-over conducting bar connecting at least one anode at the top of one section of one cell to at least one corresponding conductor bar at or adjacent to the bottom of a corresponding section of the adjacent cell. This conductor bar is advantageously connected to the inner cathode holder shell of a cathode of a cell according to the invention, as described above.

In this arrangement, the anodes in each cell can be arranged in two rows of side-by-side anodes with pairs of side-by-side anodes in the two rows connected together, and with each crossing-over conductor bar connected to at least one pair of interconnected anodes. For example, each crossing-over conductor bar is connected to two adjacent pairs of interconnected anodes.

Advantageously, the cells are arranged side-by-side in rows, the pairs of cells in each row being connected in parallel to corresponding pairs of cells in the adjacent rows. Moreover, each crossing-over conductor bar can be connected to at least two cross-wise current collector bars in the cell bottom.

This new arrangement has pairs of cells connected in parallel, having the advantage that each cell can be smaller and more efficient. Moreover, the total voltage of a cell line is consequently advantageously lower.

The invention also pertains to a system of interconnected cells for the production of aluminium by the electrolysis of an aluminium compound dissolved in a molten electrolyte, advantageously cells including the improved cathodes as defined above, wherein each cell comprises an anode suspension and current-supply superstructure and a cathode cell bottom associated with cathode current supply means.

The cells making up this system are arranged in rows, each row being made up of an alignment of pairs of side-by-side cells. The anode current-supply superstructures of the two cells of each side-by-side pair of cells of one row are connected together to a common anode busbar. The cathode current supply means of the two cells of each side-by-side pair of cells of one row are connected together and then to the common anode busbar of a corresponding side-by-side pair of cells of an adjacent row of cells.

In this manner, corresponding pairs of side-by-side cells in the rows of cells are connected together in parallel, leading to a simplification of the buswork compared to conventional arrangements. Moreover, connection of the cells in parallel doubles the current capacity and enables cells to be cut-off one at a time to allow maintenance operations on the off-circuit cells. As discussed above, each parallel-connected cell can made be smaller and more efficient, and the total voltage of a cell line reduced.

Preferably, the cells of each side-by-side pair of cells of one row are placed close together with their common anode busbar situated between them, and the cells of adjacent rows are spaced apart from one another leaving between them a walkway allowing access to all of the cells for servicing. This arrangement permits access to all cells with a reduced space for walkways, namely half as many are needed compared to conventional arrangements with walkways along both sides of the cells.

In this arrangement, the cathode current supply means preferably comprises a current collector bar that projects vertically downwards from the bottom of each cell.

BRIEF DESCRIPTION OF THE DRAWINGS

The invention will be further described with reference to the accompanying schematic drawings, in which.

DETAILED DESCRIPTION

Figure 1:
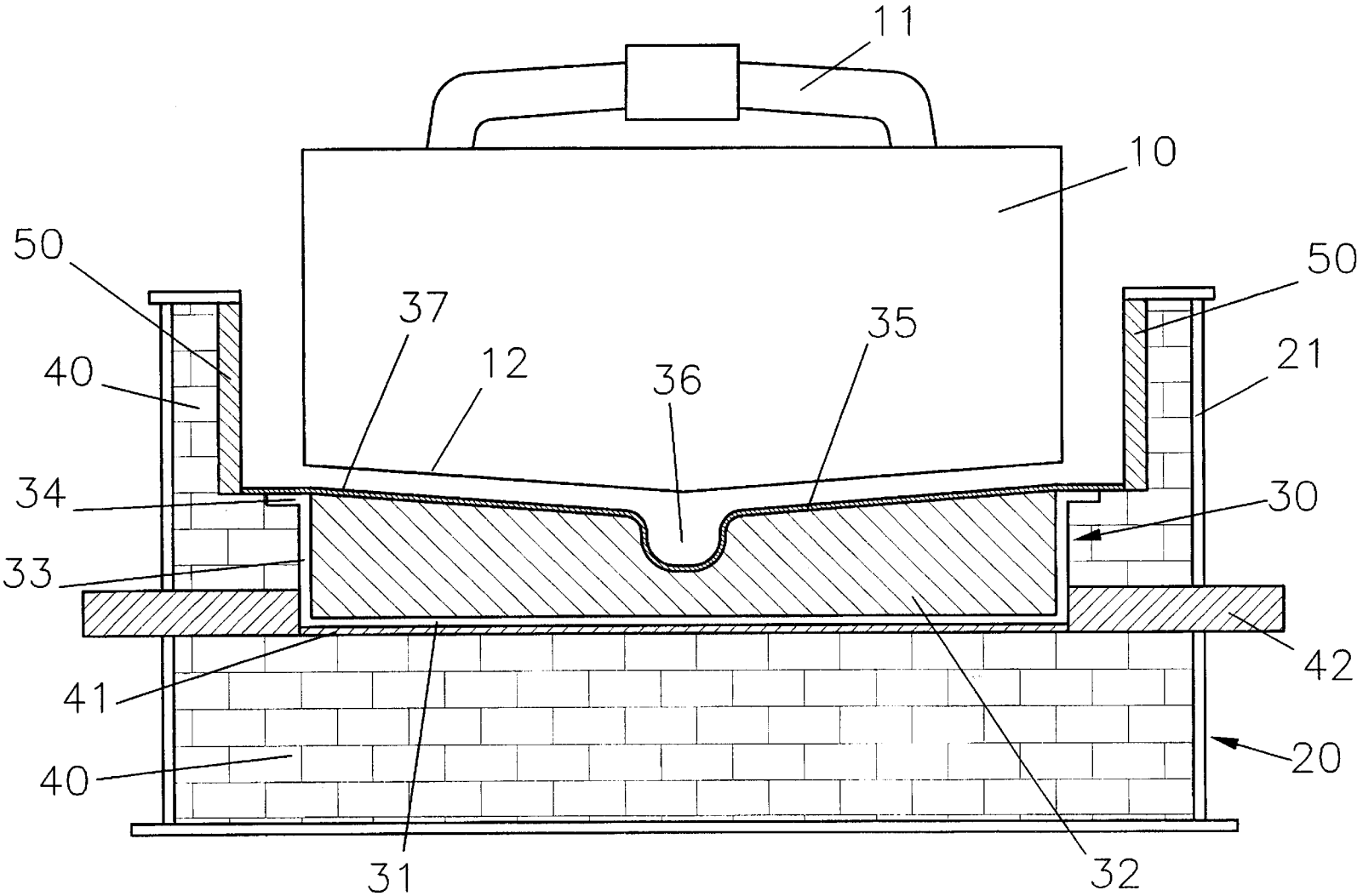
FIG. 1 is a cross-sectional view of one aluminium production cell according to the invention.

FIG. 1 schematically shows an aluminium production cell according to the invention wherein a plurality of anodes 10 are suspended by yokes 11 connected to an anode suspension and current supply superstructure (see for example FIGS. 9 and 10) which hold the anodes 10 suspended above a cathode cell bottom 20 enclosed in an outer steel shell 21 forming, with its insulating lining of refractory bricks 40, a cell trough or cathode pot.

Inside the outer steel shell 21 is housed a cathode 30 comprising an inner steel cathode holder shell 31 containing a cathode mass 32. As illustrated, the inner shell 31 has a flat bottom, side walls 33 and outwardly-directed side flanges 34 at its top. The inner shell 31 forms an open-topped container for the cathode mass 32.

The cathode mass 32 can for example be made of packed carbon powder, graphitized carbon, or stacked plates or slabs of carbon imbricated with one another and separated by layers of a material that is impermeable to the penetration of molten aluminium. Alternatively, the cathode mass can be made mainly of other electrically conductive materials or composite materials, as discussed above.

The top of the cathode 32 mass has inclined surfaces 35 leading down into a central channel 36 for draining molten aluminium. On top of the cathode mass 32, and also extending over the flanges 34, is a coating 37 of aluminium-wettable material, preferably a slurry-applied boride coating as described in U.S. Pat. No. 5,651,874 (Sekhar et al). Such coating 37 can also be applied to the inside surfaces of the bottom and sides 33 of the cathode holder shell 31, to improve electrical connection between the inner shell 31 and the cathode mass 32.

In the example of FIG. 1, the cathode mass 32 does not protrude above the tops of the sidewalls 33 of shell 31. In this embodiment, the periphery of the cathode mass 32 extends to the top of the sidewalls 33, from where it slopes down to the central channel 36.

The cathode 30 is supported as a removable unit in the cell bottom 20 in a central recess of corresponding shape in the refractory bricks 40 lining the outer steel shell 21. These refractory bricks 40 are the usual types used for lining conventional cells.

Current is supplied to the cathode 30 via transverse conductor bars 41 welded to the bottom of the inner shell 31. These conductor bars 41 are connected to current collector bars 42 which protrude laterally from the sides of the outer shell 21, these collector bars 42 being connected to external buswork (not shown).

Figure 2:
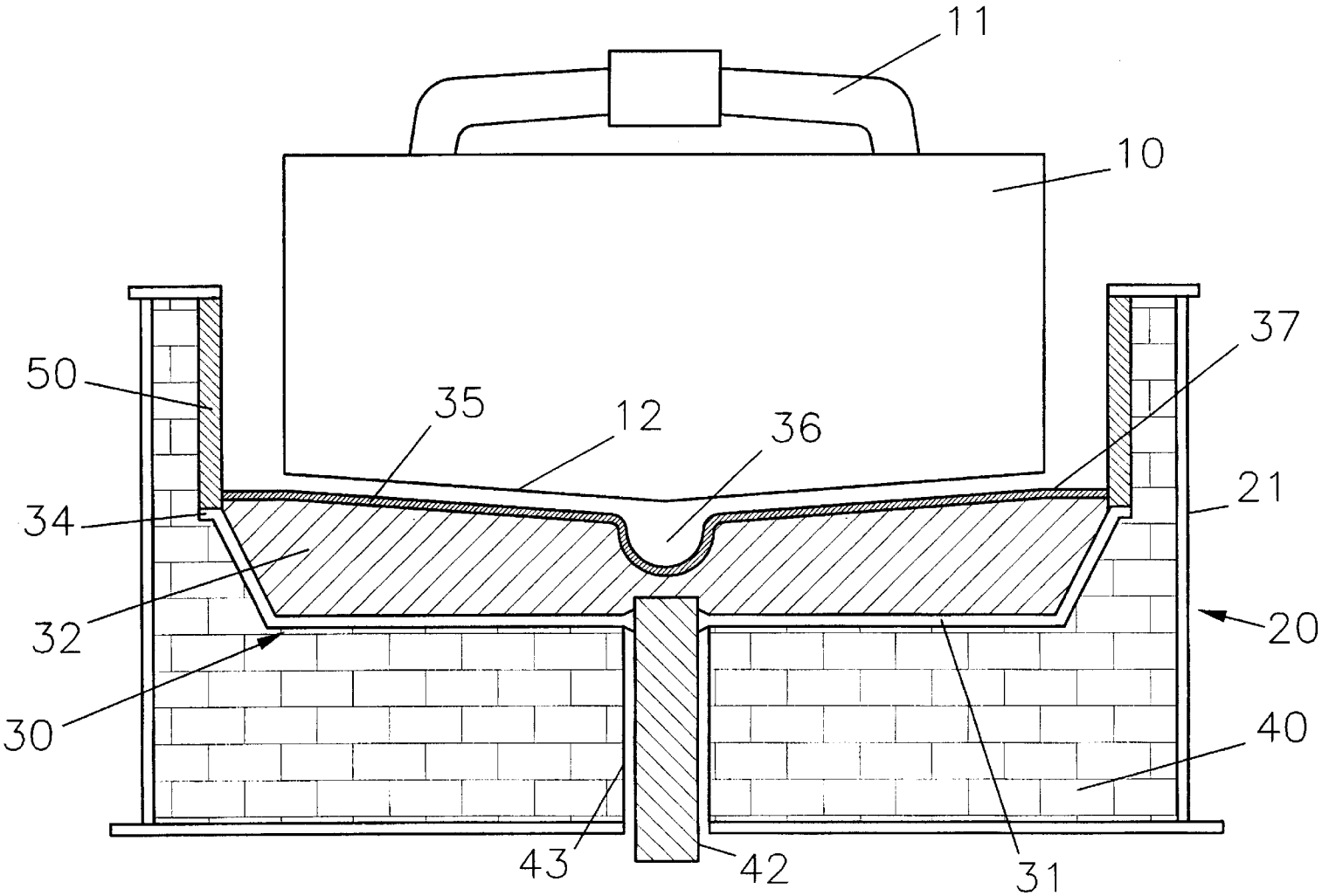
FIG. 2 is a cross-sectional view of another aluminium production cell according to the invention.

Alternatively, current could be supplied to the cathode 30 of FIG. 1, by a series of vertical current collector bars 42 extending down through vertical openings in the bottom of the lining formed by the refractory bricks 40 (see FIG. 2).

Due to the metallic conductivity of the cathode holder shell 31, these conductor bars 41 are all maintained at practically the same electrical potential leading to uniform current distribution in the collector bars 42. Moreover, the metal inner shell 31 evenly distributes the electric current in the cathode mass 32.

Inside the part of the cell side walls at the top of the outer shell 21 facing the sides of anodes 10 is a lining 50 formed for example of plates of silicon carbide. Alternatively, the lining 50 could be made of treated carbon coated with a slurry-applied coating of refractory boride, like the coating 37.

The cathode 30 can be manufactured as a separate unit that can be installed in the cell bottom 20, composed of the outer steel shell 21 lined with refractory bricks 40 and already fitted with the lateral current collector bars 42 which are ready to be connected to the transverse conductor bars 41 when the cathode 30 is installed. The silicon carbide plates 50 can be fitted before or after insertion of the cathode 30.

The cathode 30 can be produced by first forming the inner steel cathode holder shell 31 with its side walls 33 and flanges 34, then applying a boride coating 37 to the inner surface of the shell 31 if desired. The cathode mass 32 is then placed in the inner shell 31. The central channel 36 and sloping surfaces 35 can be preformed if the cathode mass 32 is made of blocks, or can be formed by a shaping operation after the cathode mass is placed in the cathode holder shell 31, for example if the cathode mass 32 is made from a compacted powder or paste. One or more coats of refractory boride coating 37 can then be applied to the top of the cathode mass 32 by the application of a slurry, drying and baking as required. Further coats of the refractory boride coating 37 can be applied to the top of the cathode mass 32, to the flanges 34 and possibly to a surrounding part of the refractory bricks 40 after the cathode 30 has been installed. The current conductor bars 41 can be welded when the inner steel shell 31 is being or has been formed, before the cathode mass 32 has been put in place.

In use, the space between the cathode 30 and the side-wall lining 50 is filled with a molten electrolyte such as cryolite containing dissolved alumina at a temperature usually about 950–970° C., and into which the anodes 10 dip. When electrolysis current is passed, aluminium is formed on the sloping cathode surfaces 35 coated with the refractory boride coating 37, and the produced aluminium continuously drains down the sloping surfaces 35 into the central channel 36 from where it is removed permanently into an internal or external storage located usually at one end of the cell.

The anodes 10, which are shown as being consumable prebaked carbon anodes, have sloping surfaces 12 facing the sloping cathode surfaces 35. The inclination of these anode surfaces 12 facilitates the release of bubbles of the anodically-released gases. As the anode 10 is consumed, it maintains its shape, keeping a uniform anode-cathode spacing. Alternatively, it would be possible for the same cell bottom 20 and its cathode 30 to be used with non-consumable or substantially non-consumable anodes.

Periodically, when the cathode 30 needs servicing, it is possible to close down the cell, remove the molten cell contents, and disassemble the entire cathode 30 to replace it with a new or a serviced cathode 30. This operation is much more convenient and less labour intensive than the conventional cell bottom relining process, has reduced risks relating to exposure to the toxic waste materials, and simplifies disposal of the toxic waste materials.

Figure 4:
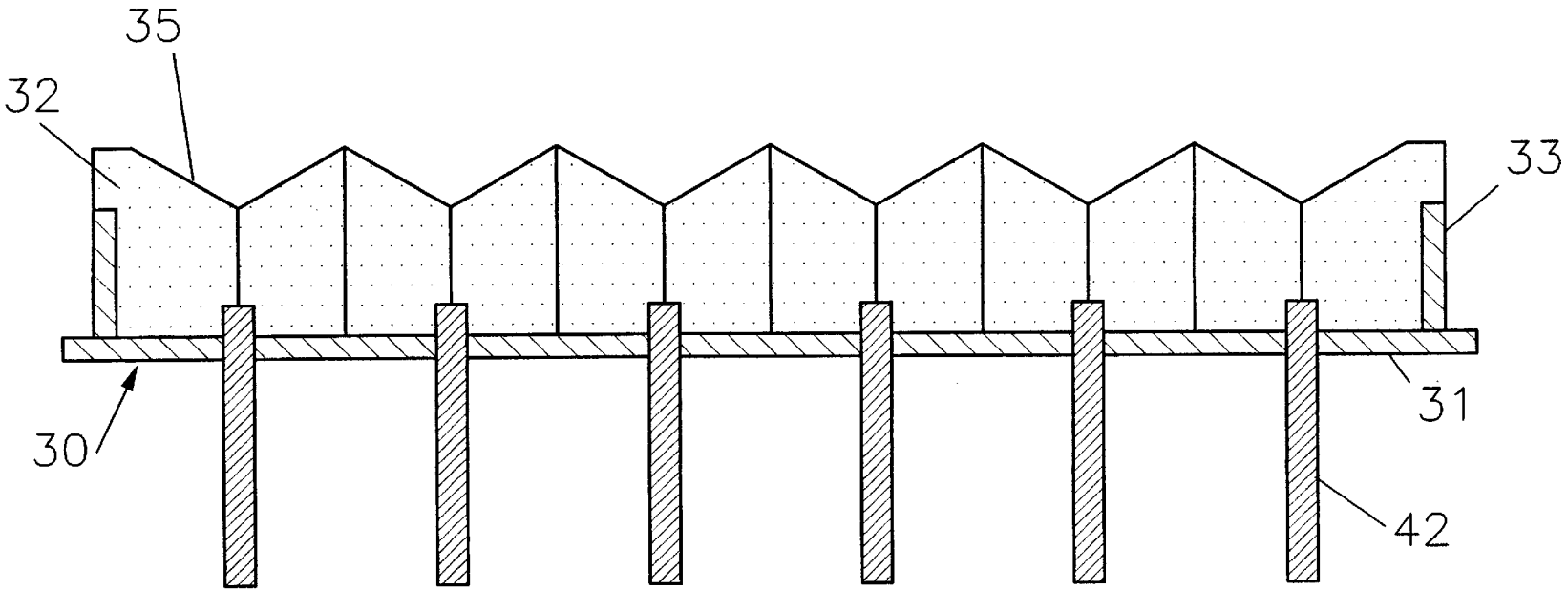
FIG. 4 shows in longitudinal cross-section an embodiment of the cathode ready to be installed in a cell.

The aluminium production cell shown in FIG. 2 is similar to that of FIG. 1 and like references have been used to designate like parts. In this design, the current collector bars 42 instead of being horizontal are vertical and extend through vertical apertures 43 in the lining of bricks 40. These collector bars 42 are welded centrally to the bottom of the inner shell 31. As illustrated in FIG. 4, several collector bars 42 are spaced apart from one another along the bottom of the inner shell 31. These collector bars 42 can have any desired cross-sectional shape : circular, rectangular, T-shaped, etc. Because the inner metal shell 31 keeps the collector bars 42 at practically the same potential, fluctuations in the current supply are avoided.

Figure 3:
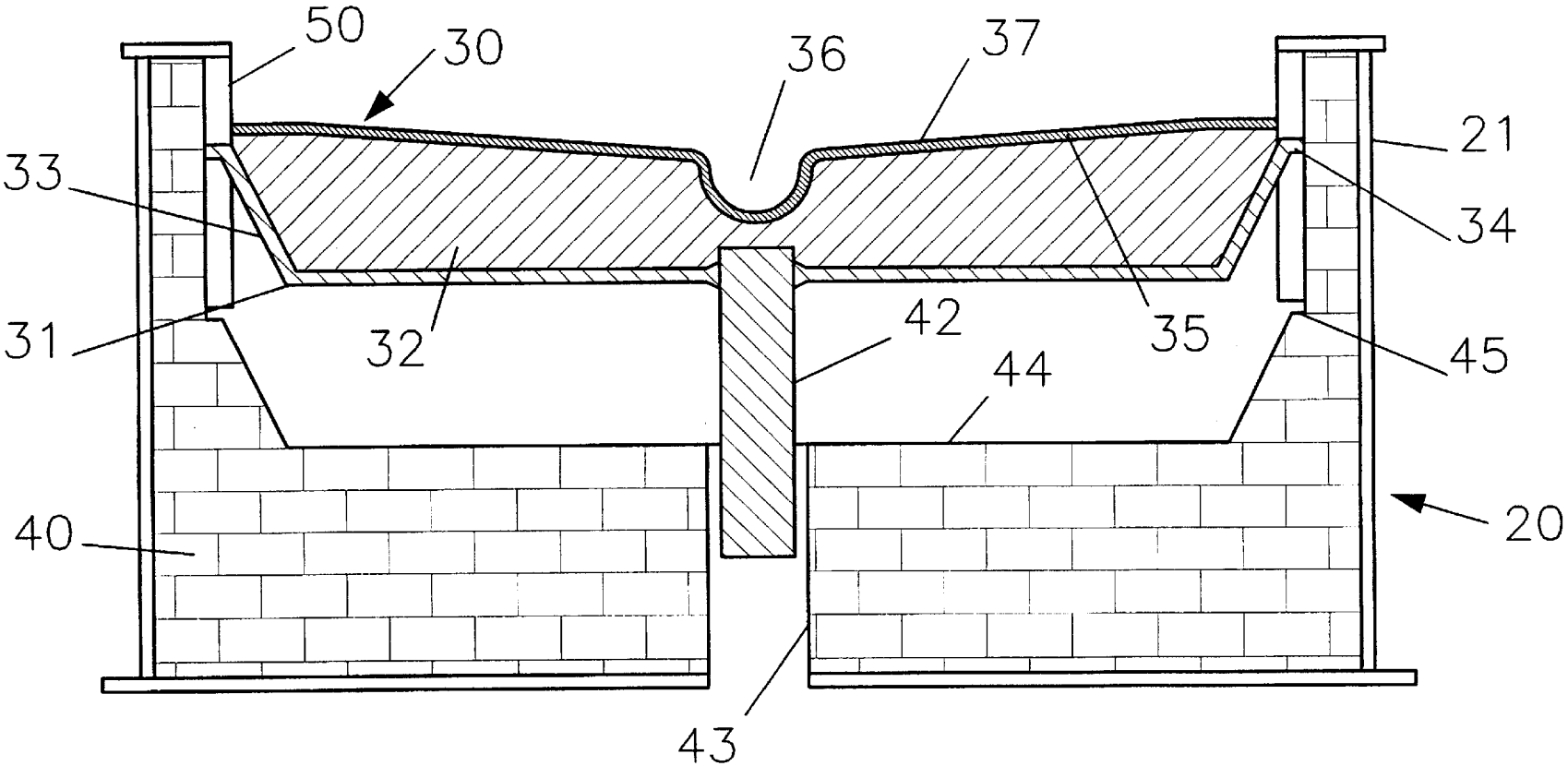
FIG. 3 shows the bottom part of the cell of FIG. 2 during assembly of a cathode unit.

The assembly method is illustrated in FIG. 3. It is possible to install the entire cathode 30 by lowering it using a crane until the bottom of the cathode holder shell 31 comes to rest on the top 44 of the lining of bricks 40 and its side flanges 34 come to rest on shoulders 45 of the cell lining. Then, the plates 50 of silicon carbide can be installed on top of the flanges 34. This assembly method is simple and labour saving, compared to the usual cell lining methods used heretofore.

To dismantle the cell, the plates 50 are removed first, then the cathode 30, after disconnecting the collector bars 42 from the negative busbar. This dismantling of the cell is remarkably simple to carry out and considerably simplifies disposal of toxic wastes.

FIG. 4 shows another embodiment of the cathode 30 ready to be installed as a unit in an aluminium production cell. This cathode comprises a metal cathode holder shell 31 made of a flat base plate to which side walls 33 are welded substantially at right angles along its side edges. These side walls 33 can extend around the entire periphery of the base plate, or only along its opposite side edges.

To the bottom of the shell 31's base plate, a series of conductor bars 42 are welded, spaced equally apart from one another along the length of the shell 31. These conductor bars 42 protrude vertically down from the shell 31, so they can pass through corresponding vertical openings in the cell bottom, for connection to an external negative busbar.

In the shell 31 is a cathode mass 32 formed of a series of blocks, for example of carbon. As shown, the cathode blocks have sloping upper surfaces 35 and are fitted together to form a series of generally V-shaped recesses. In this example, parts of the cathode blocks protrude above the top of the side walls 33 which are embedded in the sides of the end blocks.

The upper surface 35 is made up of a series of sloping surfaces in generally V-configuration, formed by placing the adjacent blocks together. Each conductor bar 42 corresponds to the junction between two adjacent blocks forming the lower part of each V. As shown, the conductor bars 42 protrude through the shell 31 and extend part of the way up the blocks 42. Alternatively, the conductor bars 42 could be welded externally to the bottom of the shell 31.

Before use, the entire sloping upper surface 35 of the cathode mass 32 is coated with an aluminium-wettable coating typically formed of slurry-applied titanium diboride.

This cathode 30 can be produced as a unit and installed in an aluminium production cell (as illustrated in FIGS. 3) by lifting it with a crane, and lowering it into the cell.

Figure 5:
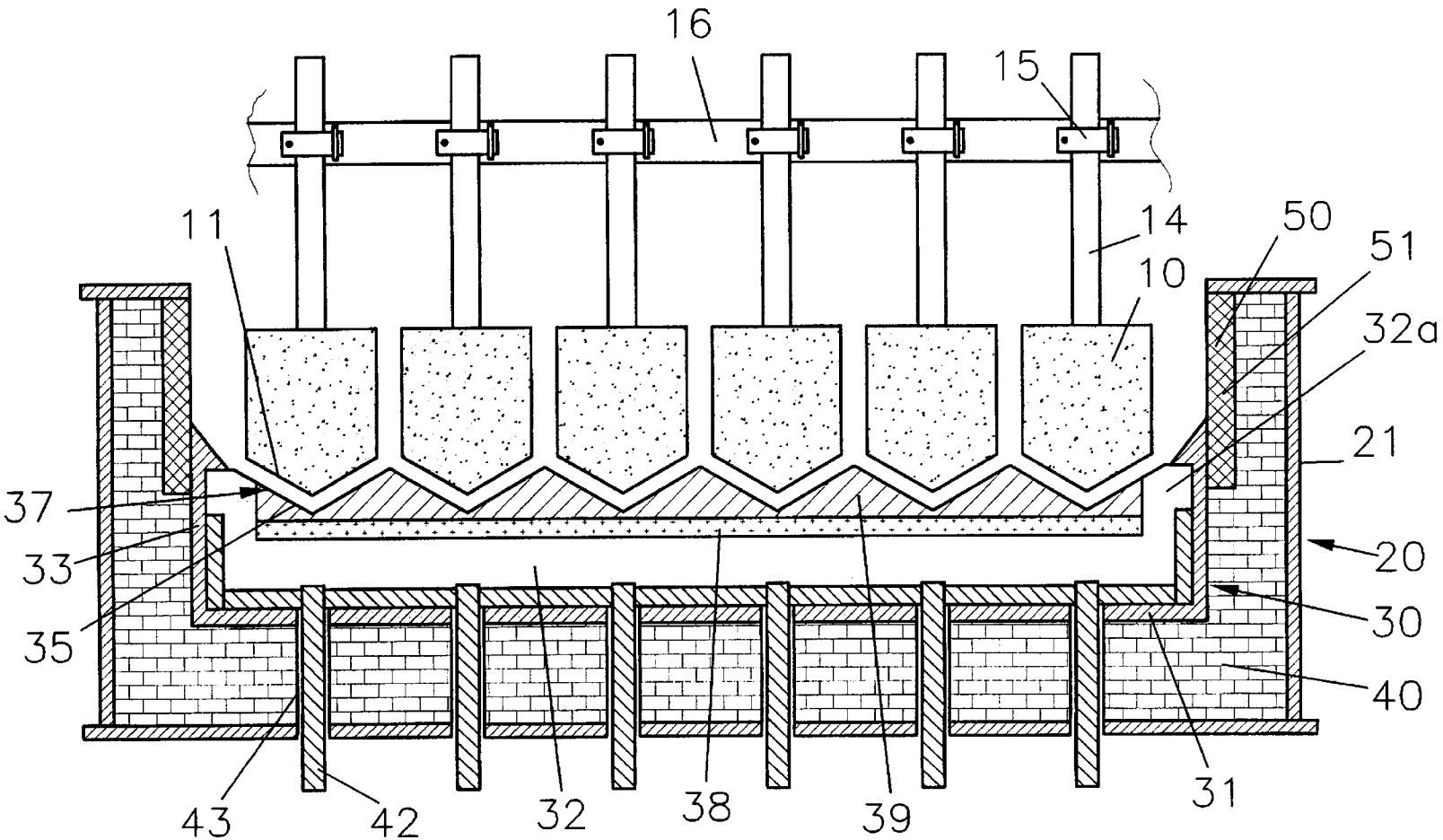
FIG. 5 is a longitudinal cross-sectional view of another aluminium production cell according to the invention.
Figure 9:
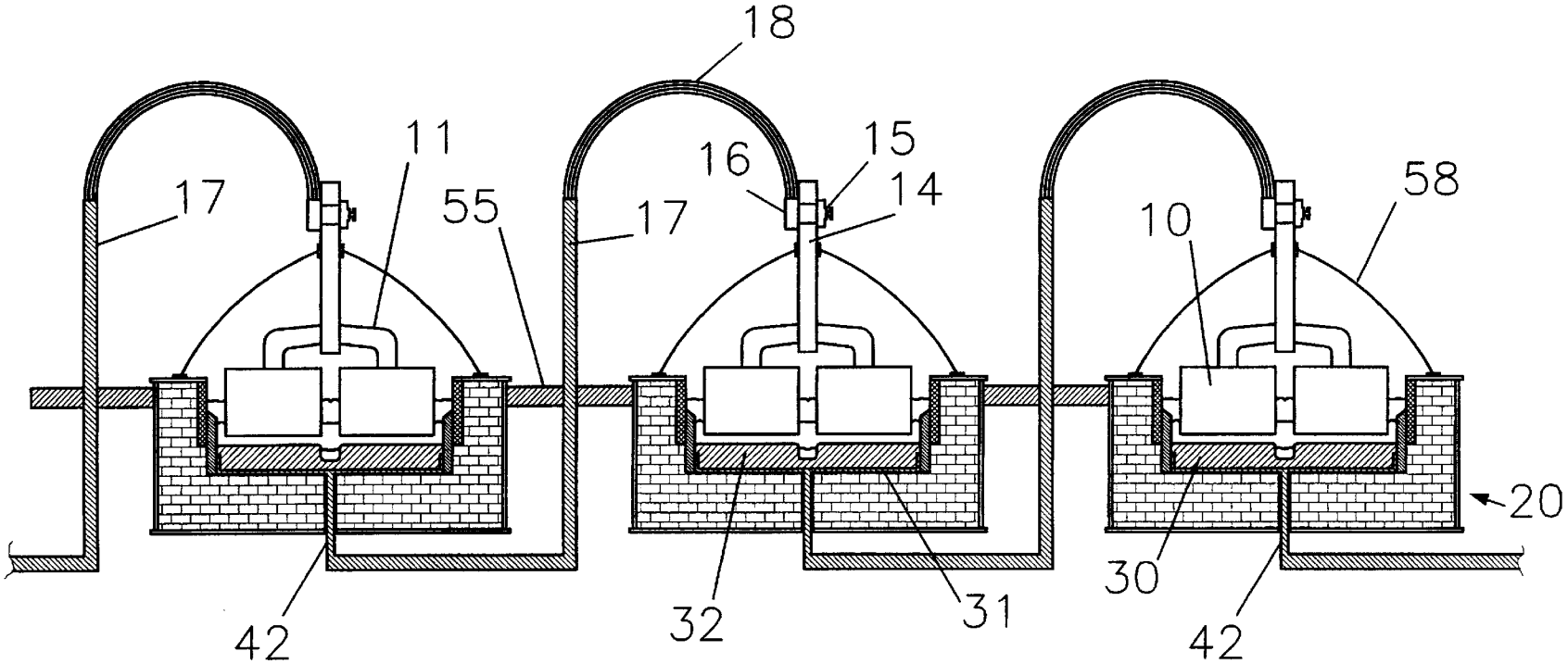
FIG. 9 is a schematic cross-section through a system of interconnected aluminium production cells according to the invention, wherein the adjacent cells of different rows are connected cross-wise in series.
Figure 10:
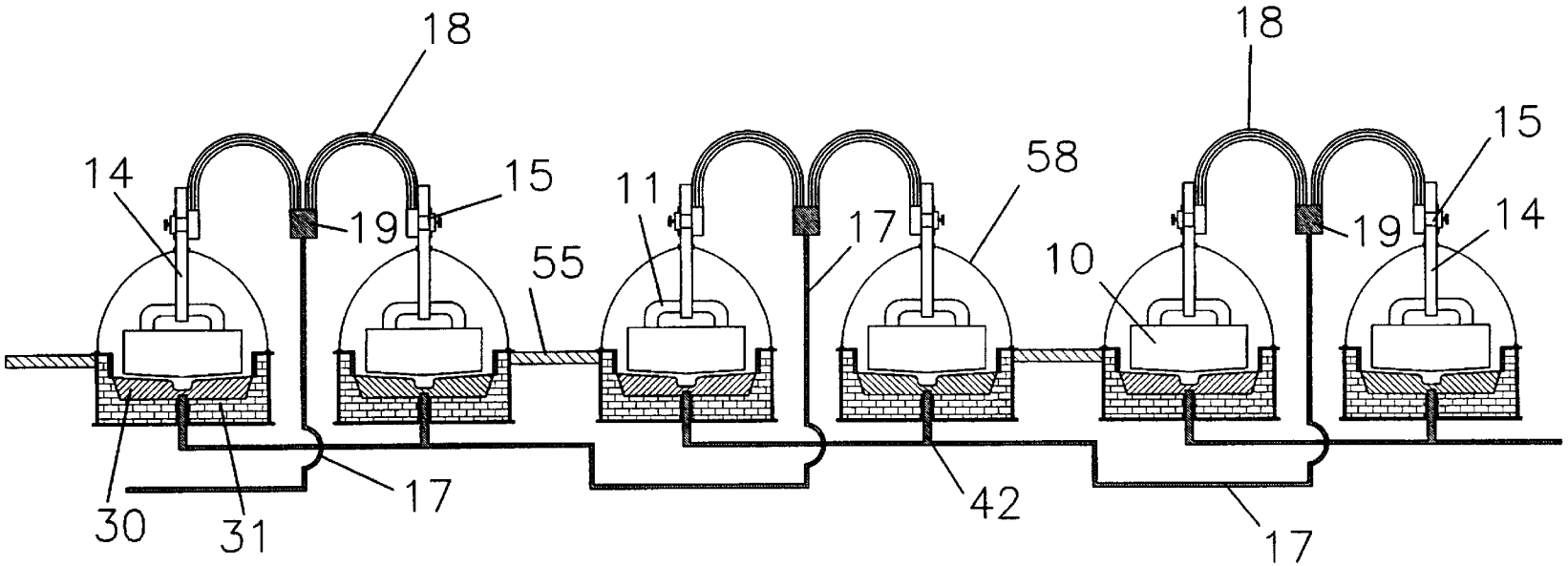
FIG. 10 is a schematic cross-section through another system of interconnected aluminium production cells according to the invention, wherein pairs of adjacent cells of different rows are connected cross-wise in parallel.

The aluminium production cell shown in longitudinal cross-section in FIG. 5 comprises a cathode 30 with a series of spaced-apart vertical current conductors 42 welded to the bottom of its inner cathode holder shell 31, these conductors 42 protruding from the lower face of the cell bottom 20 for connection to the cathode buswork (see FIGS. 9 and 10).

The cathode mass 32 is made up of several layers of a conductive material such as carbon possibly combined with materials rendering the carbon impervious to molten aluminium. The mass 32 comprises an outer layer around the bottom and sides 33 of the inner shell 31. This outer layer has a peripheral edge 32*a* surrounding a central recess that is coated with a flat layer 38 of carbon or other conductive material on top of which is a top layer 39 having sloping faces 35 coated with the layer 37 of aluminium-wettable boride. As illustrated, the upwardly-sloping side parts of the faces 35 are extended by bevelled parts of the edges 32*a* and by ramming paste 51, forming wedges along the edges of the cathode mass 32.

The sloping faces 35 of the top layer 39 are inclined alternately to form flattened V-shaped recesses above which the anodes 10 are suspended with corresponding V-shaped inclined faces 11 of the anodes facing the V-shaped recesses in the cathode 30. The anodes 10 are suspended by steel rods 14 held at an adjustable height in attachments 15 by an anode bus 16, enabling the anodes 10 to be suspended with a selected anode-cathode gap.

Assembly and disassembly of the cathode 30 of this cell is similar to what has been described previously. However, assembly of the layers making up the cathode mass 32 will be different. Its outer layer with edge 32*a* can be made of carbon blocks or compacted powder. The flat layer 38 can be compacted powder or layers of carbon tiles or plates integrating layers of an aluminium-impervious material, and the shaped toplayer 39 can be made of preformed graphitized carbon blocks. All these layers can be bonded by a conductive paste or adhesive, in particular a boride-based paste as described in U.S. Pat. No. 5,320,717 (Sekhar). Alternatively, the layered cathode mass 32 can be made mainly of an electrically-conductive non-carbon material, a conductive/non-conductive composite, or alternating carbon/non-carbon layers.

The cathode 30 is assembled first, outside the cell, then lowered using a crane into the cell bottom 20, passing the conductor bars 42 through corresponding openings 43 in the bricks 40. Then the gaps around the edges of the cathode mass 32 are filled with ramming paste 51 which is formed into the side wedges. Next, a slurry of refractory boride is applied to the sloping cathode faces 35, usually on top of a pre-coating already applied thereto, and also over the sloping wedge surfaces of the edges 32*a* and ramming paste 51. After drying and heat treatment of the boride coating 37, the cell is ready for start-up. In operation, the central recess in the cell above the cathode mass 32 contains a molten electrolyte, such as cryolite containing dissolved alumina, into which the anodes 10 dip.

For disassembly to service the cell bottom 20, the molten contents are removed from the cell, and the ramming paste 51 is broken to enable the entire cathode unit 30 to be lifted out of the cell using a crane, after having disconnected the conductor bars 42 from the cathode busbar.

Figure 6:
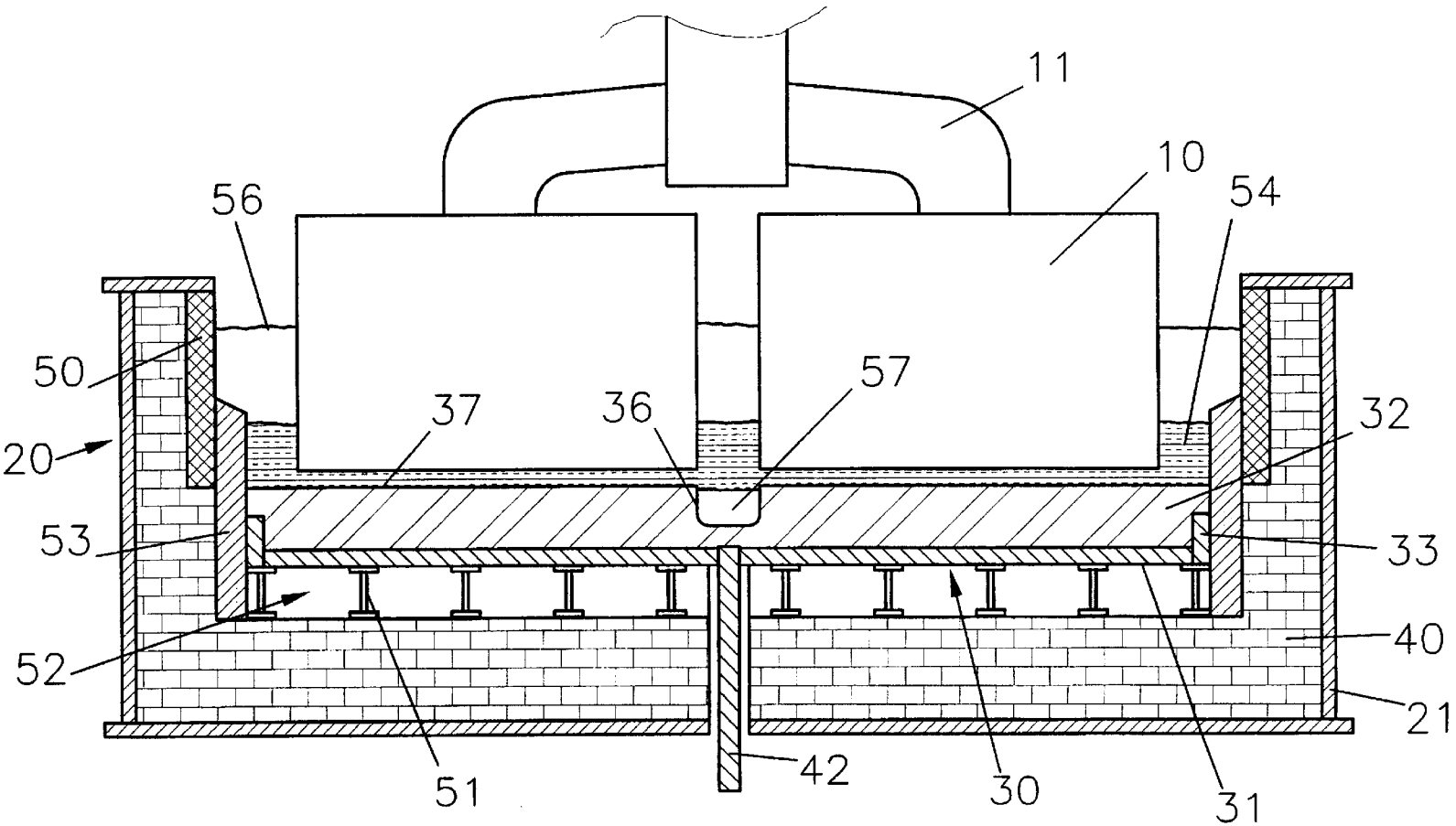
FIGS. 6 and 7 are cross-sectional views of further aluminium production cells according to the invention.

FIG. 6 shows a modified cell wherein the bottom of the cathode holder shell 31 is held spaced apart above the top of the refractory bricks 40 by girders 51, to leave therebetween an air or gas space 52 which acts as a thermic insulating space. Also, it is possible to adjust the temperature of the cathode 30 (shell 31 and cathode mass 32) by supplying a heating or cooling gas to the space 52. For example, during cell start up, the cathode 30 can be heated by passing hot gas through space 52. Or during operation, the surface of the cathode mass 32 can be cooled to make the electrolyte contacting it form a protective paste.

Also illustrated in FIG. 6 is a varied design where extra plates 53 of silicon carbide or treated carbon coated with a slurry-applied coating of refractory boride, like the coating 37, are placed in the cell lining so as to fit against the side walls 33 of shell 31 when the cathode 30 is installed.

Also shown in FIG. 6 is the molten electrolyte 54, a crust 56 of solidified electrolyte, and molten product aluminium 57 in the channel 36.

In the embodiment of FIG. 6, the facing surfaces of the cathode 30 and anode 10 are shown as flat. However, it is understood that these surface can be sloping when seen in longitudinal cross-section, as shown in FIG. 4.

Figure 7:
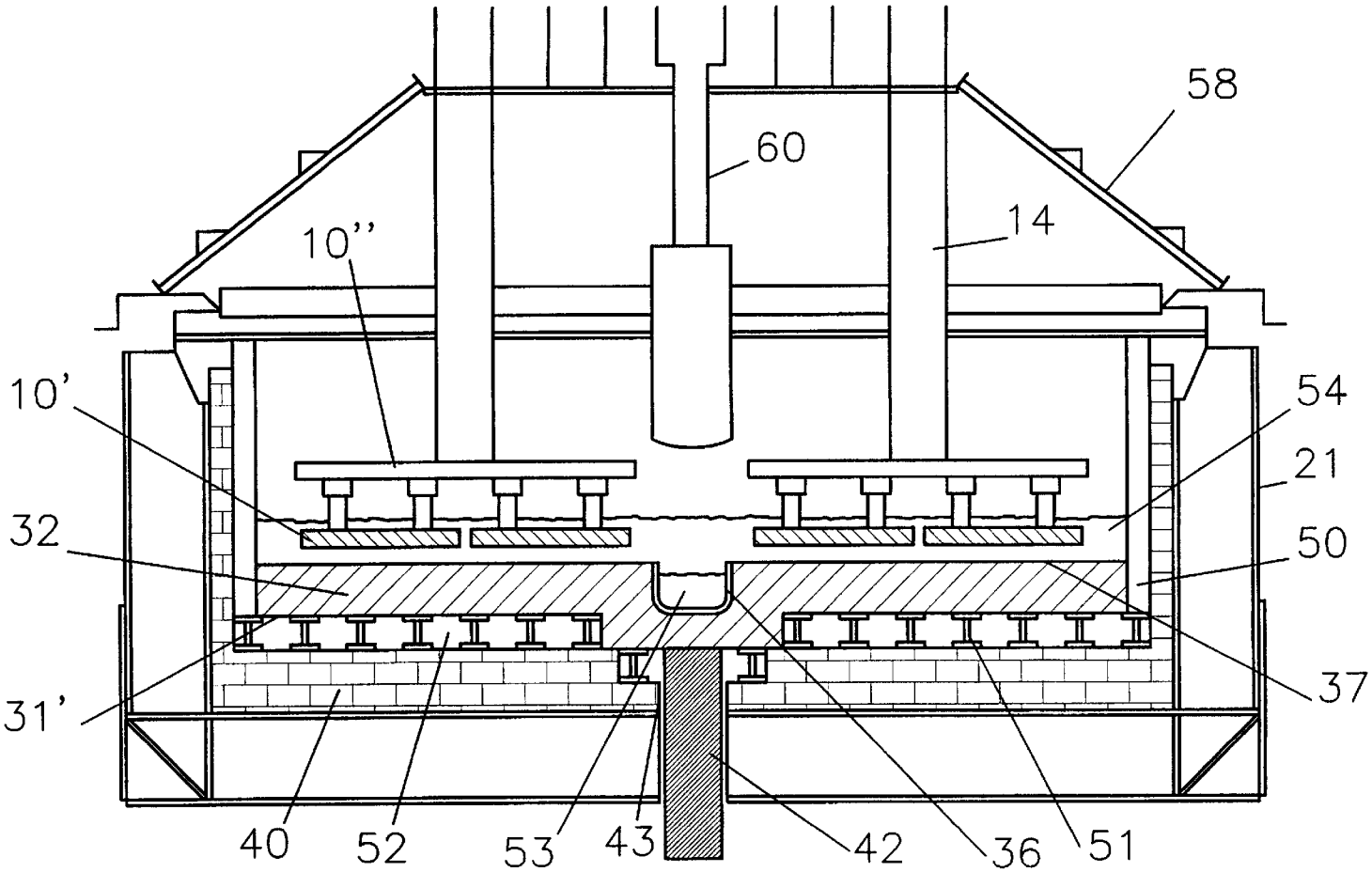

FIG. 7 illustrates a cell wherein the cathode mass 32 is supported by a cathode holder plate 31' resting on girders 51 which provide an air or gas space 52, as in FIG. 6. This cathode holder plate 31' is generally flat but has a central recess corresponding to the location of the central channel 36 which receives the drained molten aluminium 53. This recessed central part of the cathode holder plate 31' corresponds in thickness to the girders 51, and rests on the top layer of bricks 40, like the girders 51. The current collector bars 42 are welded to the bottom of this recessed central part of the cathode holder plate 31'. The central recess 36 extends down to about the level of the main part of plate 31' and is narrower than the corresponding central recess in plate 31'. The material of cathode mass 32 thus extends substantially all over the plate 31' including its recessed part. However, the sides of the cathode mass 32 stop short of the edges of the cathode holder plate 31', leaving a space to receive the silicon carbide plates forming the lining 50.

The cathode mass 32 is advantageously a composite alumina-aluminium-titanium diboride material, for example produced by micropyretic reaction of $TiO_2$, $B_2O_3$ and Al. Such composite materials exhibit a certain plasticity at the cell operating temperature; when supported by a rigid cathode holder plate 31' or shell 31, these materials have the advantage that they can accommodate for thermal differences during cell start up and operation, while maintaining good conductivity required to effectively operate as cathode mass.

The top surface of the cathode mass 32 is horizontal or very slightly inclined and is coated with a slurry-applied layer of titanium diboride, forming a drained cathode surface 37.

Above the drained cathode surfaces 37 are suspended non-carbon oxygen evolving anodes 10' fitted under a current distribution structure 10" attached at the lower end of vertical current supply bars 14. These anodes 10' are advantageously metal anodes based on nickel-iron-aluminum or nickel-iron-aluminum-copper with an oxide surface, for example as described in U.S. Pat. No. 5,510,008 (de Nora et al), possibly protected in use by an in-situ formed cerium oxyfluoride coating as described in U.S. Pat. No. 4,614,569 (Duruz et al).

The top of this cell is enclosed by covers 58 which can be opened to allow access for servicing the anodes 10'. FIG. 7 also shows a crust breaker 60 which can be lowered between the rows of anodes 10' to break the crust formed on top of electrolyte 54. At the same location, but offset longitudinally, are point feeders for supplying alumina to replenish the electrolyte 54 in the central recess 36.

Figure 8:
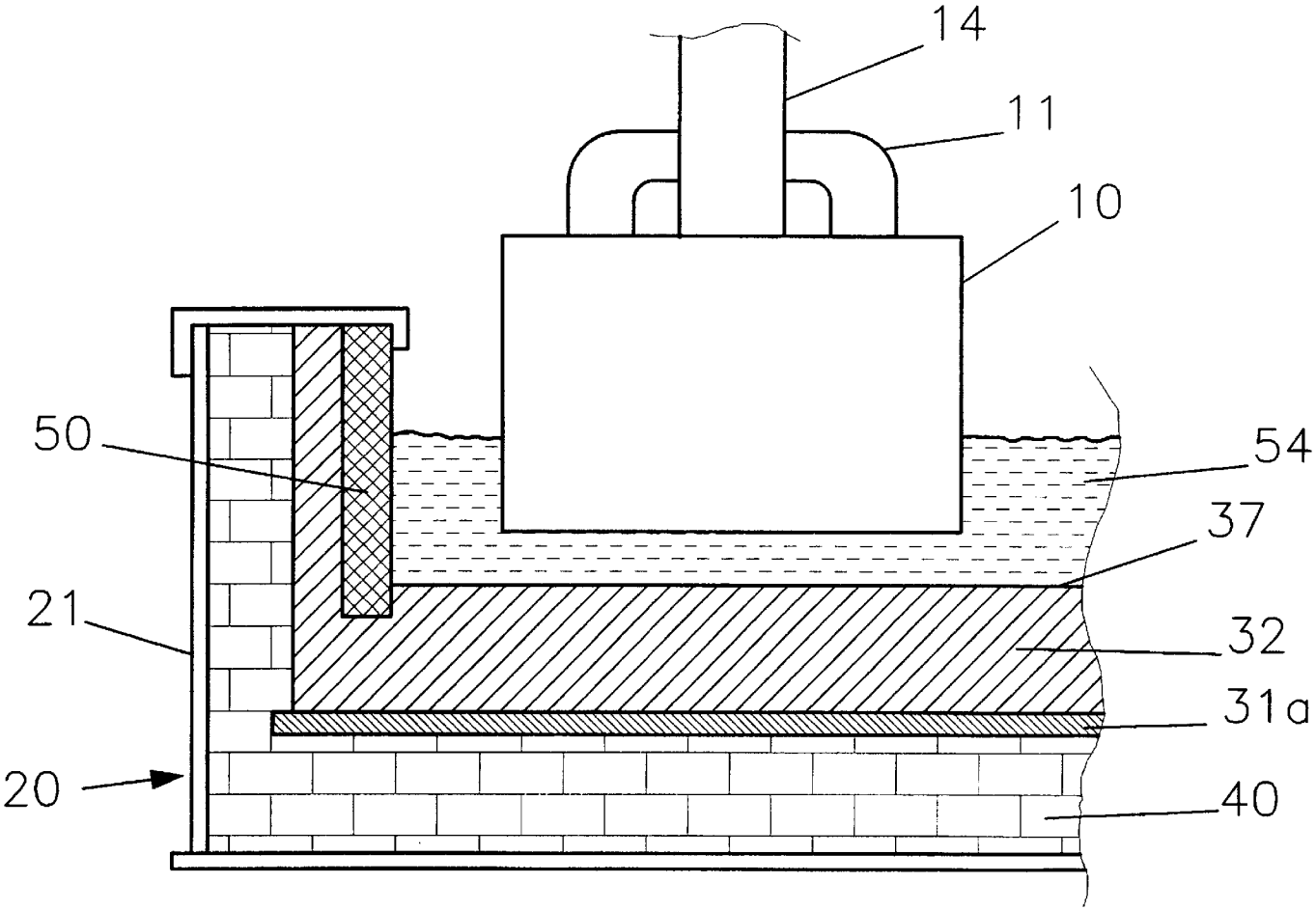
FIG. 8 is a cross-sectional view through part of another embodiment of the aluminium production cell according to the invention.
Figure 8B:
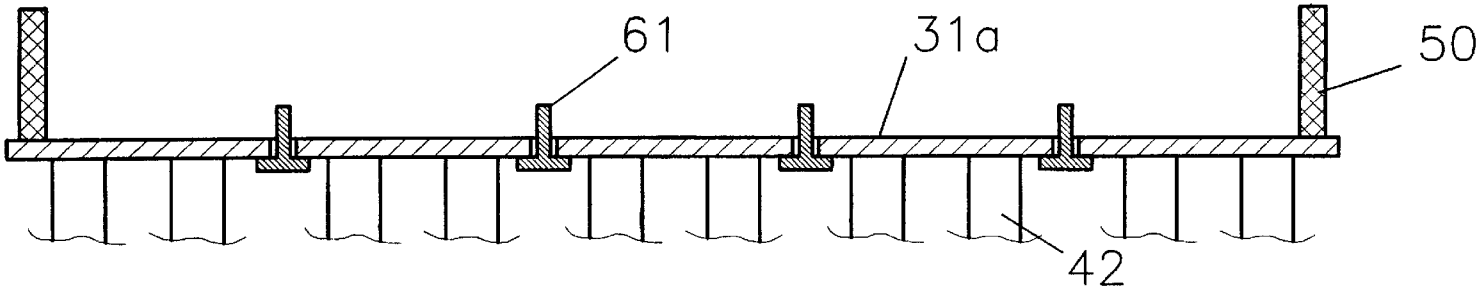
FIG. 8*b* is a cross-section along line b—b of FIG. 8*a;*

FIG. 8 illustrates part of a cell comprising a cathode holder made up of several plates, seen in a cross section through one of the cathode holder plates 31*a*, out of the plane of the current collector bars 42 (see FIG. 8*b*). The cathode pot 20 of this cell is assembled by placing a series of rectangular steel cathode holder plates 31*a*, each with two current collector bars 42, onto the lining of bricks 40. The adjacent cathode holder plates 31*a* are spaced apart and rest on girders 61 of inverted T shape resting on the top of bricks 40. Around the sides of the cathode pot 20 are lining plates 50 of silicon carbide or treated carbon, forming a shell all around the cathode pot. Inside this shell, the protruding parts of girders 61 form sub-divisions. This shell is filled with an electrically-conductive cathode mass 32, advantageously made of a composite material containing aluminium, alumina and possibly titanium diboride, and coated with an aluminium-wettable titanium diboride coating 37. This cathode mass 32 can fill the space behind the lining 50, as shown in FIG. 8.

Figure 8A:
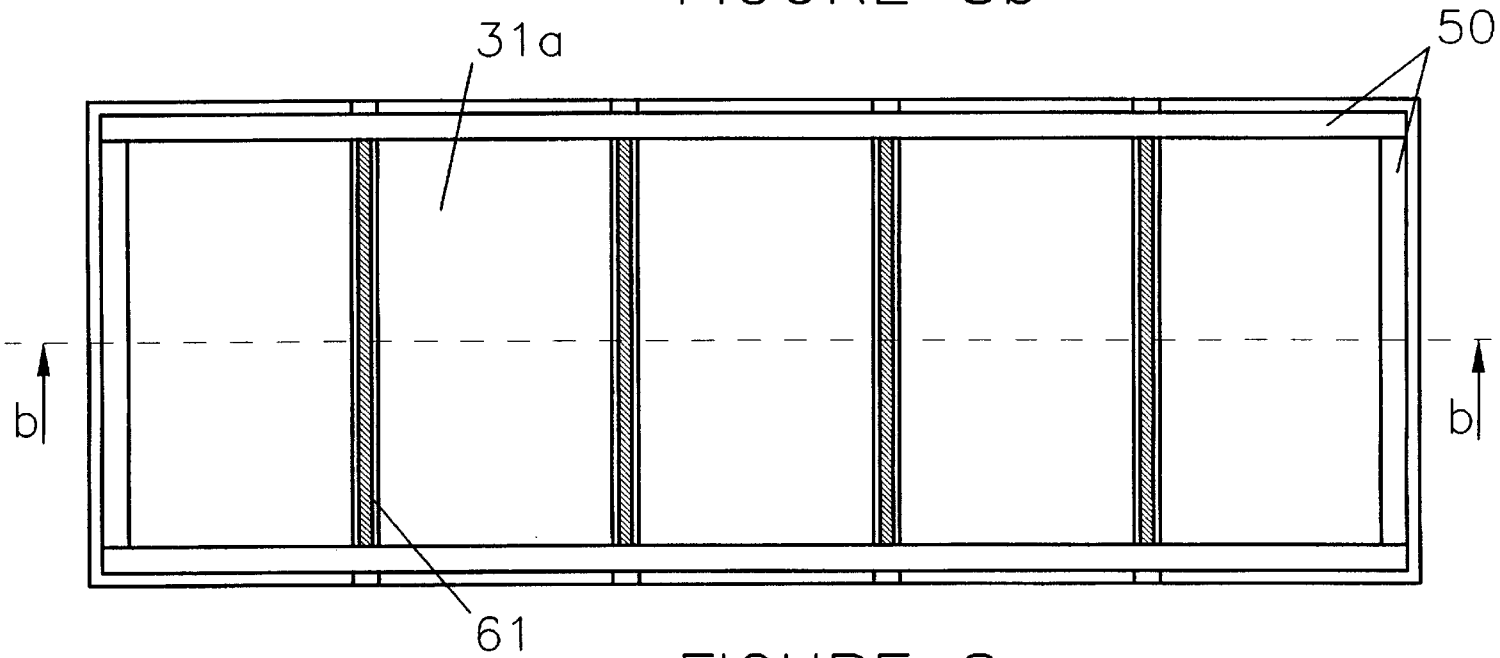
FIG. 8*a* is plan view of the cathode pot of the cell of FIG. 8 during construction.

FIGS. 8, 8*a* and 8*b* thus illustrate an embodiment of the invention wherein the cathode holder is made up of a plurality of plates 31*a* spaced from one another with the girders 61 bridging the spaces. In one variation of this embodiment, each individual plate 31*a* could already carry a cathode mass, the gaps between the masses of the adjacent plates being filled with a suitable paste or powder mix. In another variation of this embodiment, each individual plate 31*a* be replaced by an individual cathode shell containing a cathode mass whereby the cell includes several cathode holder shells.

FIG. 9 shows three cells of a series of aluminium production cells incorporating cathodes 30 as described previously, and disposed in side-by-side rows. Each cell comprises a cell base 20 forming a cathodic cell bottom having current collector bars 42 leading in to the bottom of the cell for feeding current to the cathode mass 32 via the inner cathode holder shell 31. The cell superstructure comprises anodes 10 suspended in pairs from yokes 11, a vertical iron bar 14 and attachments 15 connected to an anode bus 16 forming means for supplying current to the anodes 10.

Each cell also has a fume cover 58 that is removable or has removable parts to permit replacement of the anodes 10 when needed, and for the periodic supply of alumina to replenish the molten electrolyte.

The adjacent cells are connected so that current is conducted between them by conductor bars 17 crossing-over from one cell to an adjacent cell. As illustrated, the conductors 17 are extended by flexible aluminium sheets 18 connected to the anode bus 16 and attachment 15. Each crossing-over conducting bar 17 connects the anodes 10 at the top of one section of one cell to at least one corresponding current conductor bar 42 at the bottom of a corresponding section of the adjacent cell. Such conductor bar 42 is advantageously connected to the inner cathode holder shell 31 of a cathode 30 as described above.

Between each adjacent side-by-side pair of cells is a walkway 55 adjacent to the top of the cell trough, these walkways 55 allowing workmen to access the cells to service them.

In the illustrated arrangement, the anodes 10 in each cell are arranged in two rows of side-by-side anodes 10 with pairs of side-by-side anodes in the two rows connected together by the yokes 11. Each crossing-over conductor bar 17 is connected via the aluminium sheets 18 and attachments 15 to at least one pair of interconnected anodes 10.

Each crossing-over conductor bar 17 can be connected to one or more corresponding current collector bars 42 in the cell bottom.

FIG. 10 shows part of a system of interconnected aluminium production cells including the improved cathodes 30 as described above. Each cell has an anode suspension and current-supply superstructure 11, 14, 15 and a cathode cell bottom 20 associated with cathode current supply means formed by vertical current collector bars 42 and cathode holder shells 31.

The cells making up this system are arranged in rows, each row being made up of an alignment of pairs of side-by-side cells. FIG. 10 shows three rows of cells in side-by-side pairs. However, any convenient number of rows of cells can be arranged across the cellroom, each row being made up of a convenient number of pairs of side-by-side cells.

As shown, the anode current-supply superstructures 11, 14, 15 of the two cells of each side-by-side pair of cells of one row are connected together to a common central anode busbar 19 by flexible aluminium sheets 18.

The cathode current collector bars 42 of the two cells of each side-by-side pair of cells of one row are connected together and then to the common anode busbar 19 of a corresponding side-by-side pair of cells of an adjacent row of cells by the conductors 17 and flexible aluminium sheets 18.

In this manner, corresponding pairs of side-by-side cells in the rows of cells are connected together in parallel, leading to a simplification of the buswork compared to conventional arrangements. Connection of the cells in parallel doubles the current capacity of the cellroom and enables cells to be cut-off one at a time to allow maintenance operations on the off-circuit cells. This also has the advantage that each cell can be smaller and more efficient. Moreover, the total voltage of a cell line is consequently advantageously lower.

As illustrated, the cells of each side-by-side pair of cells of one row are placed close together with their common anode busbar 19 situated between them, and the cells of adjacent rows are spaced apart from one another leaving space for a walkway 55 allowing access to all of the cells for servicing. This arrangement permits access to all cells with a reduced space for walkways 55, namely half as many are needed compared to conventional arrangements (and the arrangement shown in FIG. 9) which have walkways along both sides of the cells.

What is claim is:

1. A cell for the production of aluminium by the electrolysis of an aluminium compound dissolved in a molten electrolyte, comprising an outer mechanical structure forming an outer shell one or more cathodes and an electric and thermic insulation separating the or each cathode from the outer shell, the outer shell and the electric and thermic insulation forming a recess that houses the or each cathode, the or each cathode comprising an inner electrically-conductive cathode holder supporting and substantially coextensive with a cathode mass, the cathode holder being connected electrically to a busbar, the or each cathode holder also serving to distribute current to its cathode mass, wherein the or each cathode holder and the thereon supported cathode mass are movable as an individual cathode unit within said recess for insertion therein and removal therefrom of said individual cathode unit.

2. The aluminium production cell of claim 1, wherein the cathode mass has an aluminium-wettable surface.

3. The aluminium production cell of claim 2, wherein the cathode is a drained cathode.

4. The aluminium production cell of claim 3, wherein the upper surface of the cathode mass comprises at least one drained surface which is at a slope.

5. The aluminium production cell of claim 4, wherein the upper surface of the cathode mass comprises opposed sloping surfaces leading down into a central channel for the removal of product aluminium.

6. The aluminium production cell of claim 4, wherein the upper surface of the cathode mass comprises a series of oppositely sloping surfaces forming therebetween a series of recesses or channels of any shape, preferably generally V-shaped.

7. The aluminium production cell of claim 2, wherein the cathode mass is made mainly of carbonaceous aluminum wettable material.

8. The aluminium production cell of claim 7, wherein the carbonaceous material comprises compacted powdered carbon or carbon paste.

9. The aluminium production cell of claim 8, wherein the carbonaceous material comprises prebaked carbon blocks.

10. The aluminium production cell of claim 7, wherein the cathode mass comprises graphite blocks, plates or tiles.

11. The aluminium production cell of claim 1, wherein the cathode mass is made mainly of an electrically conductive non-carbon material.

12. The aluminium production cell of claim 11, wherein the cathode mass is made of a composite material made of an electrically conductive material and an electrically non-conductive material.

13. The aluminium production cell of claim 12, wherein the non-conductive material is alumina, cryolite, or other refractory oxides, nitrides, carbides or combinations thereof.

14. The aluminium production cell of claim 13, wherein the conductive material contains at least one metal from aluminium, titanium, zinc, magnesium, niobium, yttrium or cerium, and alloys and intermetallic compounds thereof.

15. The aluminium production cell of claim 12, wherein the composite material is a mass comprising alumina with aluminium or an aluminium alloy.

16. The aluminium production cell of claim 15, wherein the composite material is a mass made of alumina, titanium diboride and aluminium.

17. The aluminium production cell of claim 16, wherein the composite material is obtained by reaction in which the reactants are $TiO_2$, $B_2O_3$ and Al.

18. The aluminium production cell of claim 12, wherein the conductive material contains at least one metal from Groups IIA, IIB, IIIA, IIIB, IVB, VB and the Lanthanide series of the Periodic Table, and alloys and intermetallic compounds thereof.

19. The aluminium production cell of claim 18, wherein the metal has a melting point from 650° C. to 970° C.

20. The aluminium production cell of claim 1, wherein the cathode mass is substantially resistant and impervious to molten aluminium and to the molten electrolyte.

21. The aluminium production cell of claim 1, wherein the cathode mass comprises active cathode material and reinforcing material.

22. The aluminium production cell of claim 1, wherein the cathode mass comprises layers of imbricated tiles or slabs of: carbon, an electrically conductive material, or a composite material made of electrically conductive material and electrically non-conductive material.

23. The aluminium production cell of claim 22, wherein the cathode mass comprises a cloth of aluminium-impervious material between the layers of tiles or slabs.

24. The aluminium production cell of claim 1, wherein the cathode holder is a metallic shell having upwardly-protruding side edges.

25. The aluminium production cell of claim 24, wherein the metallic cathode holder shell has a substantially flat bottom from which the upwardly-protruding side edges are angled out, or are substantially at right angles, or are angled inwardly relative to the substantially flat bottom.

26. The aluminium production cell of claim 24, wherein the side edges of the cathode holder shell have outwardly projecting flanges.

27. The aluminium production cell of claim 1, wherein the cathode holder has a curved bottom or a generally V-shaped bottom in cross section.

28. The aluminium production cell of claim 1, wherein the cathode holder is made of a sheet of imperforate metal.

29. The aluminium production cell of claim 1, wherein the cathode holder is made of a sheet of perforated metal.

30. The aluminium production cell of claim 1, wherein the cathode holder is made of a plurality of metal members with or without spacings between the members.

31. The aluminium production cell of claim 1, wherein the top of the cathode mass comprises parts which protrude above the sides of the cathode holder.

32. The aluminium production cell of claim 1, wherein the top of the cathode mass does not extend above the sides of the cathode holder.

33. The aluminium production cell of claim 1, wherein the cathode holder is connected to the outside of the outer shell by a plurality of current collector bars, the cathode holder maintaining the collector bars at practically the same electrical potential to provide a constant current distribution in the collector bars.

34. The aluminium production cell of claim 33, wherein the cathode current collector bars extend down through the bottom of the cell.

35. The aluminium production cell of claim 34, wherein the current collector bars are spaced apart along the center line of the cathode holder or are symmetrically distributed.

36. The aluminium production cell of claim 33, wherein the cathode current collector bars extend out through the sides of the cell.

37. The aluminium production cell of claim 1, wherein the upper surface of the cathode mass is coated with a coating of refractory aluminium-wettable material.

38. The aluminium production cell of claim 1, wherein the upper surface of the cathode holder in contact with the cathode mass is coated with a layer of refractory aluminium-wettable material.

39. The aluminium production cell of claim 1, comprising at least one aluminium-wettable surface that comprises a refractory boride.

40. The aluminium production cell of claim 1, comprising an aluminium-wettable coating applied from a slurry of particles of aluminium-wettable material.

41. The aluminium production cell of claim 40, comprising an aluminium-wettable surface obtained by applying a top layer of refractory aluminium wettable material over the upper surface of the cathode mass and over parts of the cell surrounding the cathode mass and in contact with the electrolyte.

42. The aluminium production cell of claim 1, wherein the top of the cathode mass comprises bodies such as tiles or blocks made of or coated with an aluminium-wettable electrically-conductive material.

43. The aluminium production cell of claim 42, wherein said bodies protrude upwardly from a cathode mass made of an electrically-conductive material.

44. The aluminium production cell of claim 43, wherein the cathode mass is coated with an aluminium-wettable material.

45. The aluminium production cell of claim 1, wherein the cathode holder(s) supporting the cathode mass is/are removably mounted in the outer shell of the cell.

46. The aluminium production cell of claim 45, wherein the current collector bars are fixed to the bottom of the removable cathode holder, the current collector bars extending down though openings in the electric and thermic insulation and through the bottom of the outer shell of the cell.

47. The aluminium production cell of claim 1, wherein an air or gas space is provided between the cathode holder and the electric and thermic insulation.

48. A cathode unit for a cell as defined in claim 1 which cell has a recess for insertion therein and removal therefrom of said individual cathode unit, the cathode unit comprising an inner electrically-conductive cathode holder supporting and substantially coextensive with a cathode mass, the cathode holder being arranged for electrical connection to a busbar, the or each cathode holder(s) also serving to distribute current to its cathode mass, wherein the cathode holder and the theron supported cathode mass forming said individual cathode unit which is movable within said call recess for insertion therein and removal therefrom of said individual unit.

49. The cathode unit of claim 48, wherein the cathode holder is a metallic shell having upwardly-protruding side edges.

50. The cathode unit of claim 49, wherein the cathode holder shell has a substantially flat bottom from which the side edges are angled out, are substantially at right angles, or are angled inwardly relative to the substantially flat bottom.

51. The cathode unit of claim 49, wherein the cathode holder is a shell or plate made of a sheet of perforated metal.

52. The cathode unit of claim 48, wherein the upwardly-protruding edges have outwardly projecting flanges.

53. The cathode unit of claim 48, wherein the cathode holder has a curved bottom or a generally V-shaped bottom in cross section.

54. The cathode unit of claim 48, comprising a plurality of spaced apart current collector bars connected at approximately right angles to the bottom of the cathode holder shell or plate.

55. The cathode unit of claim 54, wherein the current collector bars are spaced apart along the center line of the cathode holder or are symmetrically distributed.

56. The cathode unit of claim 48, wherein the cathode current collector bars extend out of the sides of the cathode.

57. The cathode unit of claim 48, wherein the cathode holder is a shell or plate made of a sheet of imperforate metal.

58. The cathode unit of claim 48, wherein the cathode holder is a shell or plate made of a plurality of metal members with or without spacings between the members.

59. The cathode unit of claim 48, wherein the top of the cathode mass comprises parts which protrude above the sides of the cathode holder.

60. The cathode unit of claim 48, wherein the top of the cathode mass does not extend above the sides of the cathode holder.

61. The cathode unit of claim 48, wherein the top of the cathode mass comprises bodies such as tiles or blocks made of or coated with an aluminium-wettable electrically-conductive material.

62. The cathode unit of claim 61, wherein said bodies protrude upwardly from a cathode mass made of an electrically-conductive material.

63. The cathode unit of claim 61, wherein the cathode mass is coated with an aluminium-wettable material.

64. The cathode unit of claim 48, wherein the cathode mass is made mainly of carbonaceous material.

65. The cathode unit of claim 48, wherein the cathode mass comprises an aluminium-wettable surface.

66. The cathode unit of claim 48, wherein the cathode is a drained cathode.

67. The cathode unit of claim 48, wherein the cathode comprises bodies such as tiles or blocks.

68. An arrangement of interconnected aluminium production cells according to claim 1, connected together by crossing-over busbars from one cell to an adjacent cell, wherein the busbar connected to the cathode holder of one cell is connected to the anode current supply of an adjacent cell.

69. The arrangement of claim 68, wherein pairs of cells are arranged side-by-side in rows, the pairs of cells in each row being connected in parallel to corresponding pairs of cells in the adjacent rows.

70. The arrangement of claim 69, wherein each cell of side-by-side pair of cells of one row comprises an anode current-supply superstructures, the superstructures of one row being connected together to a common anode busbar, the cathode holders of two cells of each side-by-side pair of cells of one row being connected together and to the common anode busbar of a corresponding side-by-side pair of cells of an adjacent row of cells.

71. The arrangement of claim 69, wherein the cells of each side-by-side pair of cells of one row are placed close together with their common anode busbar situated therebetween, and the cells of adjacent rows are spaced apart from one another leaving therebetween a walkway allowing access to all of the cells for servicing.

72. The arrangement of claim 68, wherein the anodes in each cell are arranged in two rows of side-by-side anodes with pairs of side-by-side anodes in the two rows connected together, and wherein each crossing-over busbar is connected to at least one pair of interconnected anodes.

73. The arrangement of claim 68, wherein each crossing-over busbar is connected to two adjacent pairs of interconnected anodes.

74. The arrangement of claim 68, wherein each crossing-over busbar is connected to at least two crosswise current feeders in the cell bottom.

75. A method of manufacturing the cathode unit of a cell for the production of aluminium by the electroysis of an aluminium compound dissolved in a molten electrolyte, which cell comprises an outer mechanical structure forming an outer shell one or more cathodes and an electric and thermic insulation separating the or each cathode from the outer shell, the outer shell and the electric and thermic insulation forming a recess that houses the or each cathode, the or each cathode comprising an inner electrically-conductive cathode holder supporting and substantially coextensive with a cathode mass, the cathode holder being connected electrically to a busbar, the or each cathode holder also serving to distribute current to its cathode mass, wherein the or each cathode holder and the thereon supported cathode mass forming said individual cathode unit which is movable within said recess for insertion therein and removal therefrom of said individual cathode unit, said method comprising providing a cathode holder, placing a cathode mass on the cathode holder so the cathode mass is substantially coextensive with, mechanically supported by and electrically connected to the cathode holder, and connecting at least one current collector bar to the underside of the cathode holder or to its side(s).

76. A method of installing a cathode unit in a cell for the production of aluminium by the electrolysis of an aluminium compound dissolved in a molten electrolyte, which cell comprises a recess formed by an outer shell and an electric and thermic insulation for housing the cathode unit, said method comprising placing an electrically-conductive cathode mass on a cathode holder to form a cathode unit wherein current can be supplied to the cathode mass by a current collector bar and distributed over the cathode mass by the cathode holder, installing the cathode unit comprising the cathode holder and the cathode mass in said recess, and connecting the cathode holder by a current collector bar to a busbar outside the outer shell, the cathode holder and the theron supported cathode mass being moved as an individual cathode unit within said recess during insertion and being removable therefrom.

77. A method of supplying electric current to a cathode unit of a cell for the production of aluminium by the electrolysis of an aluminium compound dissolved in a molten electrolyte, which cell comprises a recess formed by an outer shell and an electric and thermic insulation for housing the cathode unit, the cathode unit comprising an inner electrically-conductive cathode holder supporting and substantially coextensive with a cathode mass, the cathode holder and the theron supported cathode mass being arranged to be movable as an individual cathode unit within said recess for insertion therein and removal therefrom of said individual cathode unit, the method comprising supplying current via a cathode current collector bar to the bottom of the cathode mass, uniformly distributing the current supplied via the current collector bar over the entire bottom of the cathode mass by means of the cathode holder, and passing the current from the cathode holder into the cathode mass.

78. A method of transforming an existing Hall-Heroult cell, comprising removing any used cathode after shutting down the cell, refurbishing and/or rebuilding an insulating lining formed by electric and thermic insulation, and installing one or more new cathode units according to the method of claim 76.

79. A method of renovating an aluminium production cell comprising a cathode unit after the cell has been taken out of service, which cell comprises a recess formed by an outer shell and an electric and thermic insulation for housing the cathode unit the cathode unit comprising an inner electrically-conductive cathode holder supporting and substantially coextensive with a cathode mass, the cathode holder and the theron supported cathode mass being arranged to be movable as a individual cathode unit within said recess for insertion therein and removal therefrom of said an individual unit, the method comprising removing the cathode unit from said recess and replacing it by inserting a new or renovated cathode unit into said recess.

80. A method of producting aluminium using a cell for the production of aluminium by the electrolysis of an aluminium compound dissolved in a molten electroyte, which cell comprises an outer mechanical structure forming an outer shell one or more cathodes and an electric and thermic insulation separating the or each cathode from the outer shell, the outer shell and the electric and thermic insulation a recess that houses the or each cathode, the or each cathode comprising an inner electrically-conductive cathode holder supporting and substantially coextensive with a cathode mass, the cathode holder being connected electrically to busbar, the or each cathode holder also serving to distribute current to its cathode mass, wherein the or each cathode holder and the thereon supported cathode mass are movable as an individual cathode unit within said recess for insertion then and removal therefrom of said individual cathode unit, said method comprising supplying current to the cathode unit via the current collector bar and the cathode holder which distributes the current uniformly to the cathode mass, the cathodeholder maintaining the bottom of the cathode unit and the current collector bars at practically the same electrical potential.

81. The method of producing aluminium of claim 80, wherein the surface of the cathode mass is maintained at a temperature corresponding to a paste state of the electrolyte whereby the cathode mass is protected from chemical attack.

82. The method of producing aluminium of claim 81, wherein the surface of the cathode mass is maintained at the selected temperature by supplying gas via an air or gas space between the cathode holder and the electric and thermic insulation.

83. A method of starting up a cell for the production of aluminium by the electrolysis of an aluminium compound dissolved in a molten electrolyte, which cell comprises an outer mechanical structure forming an outer shells one or more cathodes and an electric and thermic insulation separating the or each cathode from the outer shell, the outer shell and the electric and thermic insulation forming a recess that houses the or each cathode, the or each cathode comprising an inner electrically-conductive cathode holder supporting and substantially coextensive with a cathode mass, the cathode holder being connected electrically to a busbar, the or each cathode holder also serving to distribute current to its cathode mass, wherein the or each cathode holder and the thereon supported cathode mass are movable as an individual cathode unit within said recess for insertion therein and removal therefrom of said individual cathode unit, said method comprising heating the cathode unit by supplying beating and gas via an air or gas space provided between the cathode holder and the electric and thermic insulation.

* * * * *